US005462846A

United States Patent [19]

Yoneyama

[11] Patent Number: 5,462,846

[45] Date of Patent: Oct. 31, 1995

[54] SILVER HALIDE COLOR PHOTOGRAPHIC MATERIAL

[75] Inventor: Hiroyuki Yoneyama, Kanagawa, Japan

[73] Assignee: Fuji Photo Film Co., Ltd., Kanagawa, Japan

[21] Appl. No.: 346,193

[22] Filed: Nov. 22, 1994

[30] Foreign Application Priority Data

Nov. 22, 1993 [JP] Japan ..... 5-313974

[51] Int. Cl.[6] ..... G03C 1/46

[52] U.S. Cl. ..... 430/507; 430/512; 430/517; 430/931; 430/627

[58] Field of Search ..... 430/512, 517, 430/507, 931, 627

[56] References Cited

U.S. PATENT DOCUMENTS

| | | | |
|---|---|---|---|
| 3,860,425 | 1/1975 | Ono et al. | 430/546 |
| 4,199,363 | 4/1980 | Chen | 430/512 |
| 5,200,307 | 4/1993 | Takahashi | 430/507 |
| 5,332,655 | 7/1994 | Shono | 430/512 |

FOREIGN PATENT DOCUMENTS

| | | | |
|---|---|---|---|
| 63-264748 | 11/1988 | Japan . | |
| 0264748 | 11/1988 | Japan | 430/512 |
| 4-19185 | 1/1992 | Japan . | |
| 1346764 | 2/1974 | United Kingdom | 430/512 |
| 2016017 | 9/1979 | United Kingdom . | |
| 2127569 | 4/1984 | United Kingdom | 430/512 |

*Primary Examiner*—Thomas R. Neville
*Attorney, Agent, or Firm*—Sughrue, Mion, Zinn, Macpeak & Seas

[57] ABSTRACT

Disclosed is a silver halide color photographic material having at least one non-coloring layer. The layer contains (i) at least one water-insoluble polymer having a number average molecular weight of less than 2000, which is obtained obtained by polymerizing at least one monomer having an aromatic group, and optionally contains (ii) at least one UV absorbent selected from 2-(2' -hydroxyphenyl)benzotriazoles, benzophenones and triazines and (iii) at least one high boiling point organic solvent having a refractive index of 1.50 or less. The photographic material has high light fastness.

12 Claims, No Drawings

SILVER HALIDE COLOR PHOTOGRAPHIC MATERIAL

FIELD OF THE INVENTION

The present invention relates to a silver halide color photographic material. Precisely, it relates to a silver halide color photographic material capable of forming a stable color image and preventing stains in the white background when exposed to light.

BACKGROUND OF THE INVENTION

To form a color photographic image on a silver halide color photographic material, widely employed is a method of exposing a photographic material having three photographic, yellow, magenta and cyan couplers contained in its light-sensitive emulsion layers and processing the thus-exposed material for color development. It is desired that the color dyes to be formed in this way are vivid yellow, magenta and cyan dyes all having a little side absorption, thus giving color photographic images of high color reproducibility. On the other hand, it is also desired that the color photographic images formed have high stability when stored under various conditions. In particular, color photographic images to be exhibited for viewing in light are often faded to have a lowered color image density or are often stained in yellow in the white background areas, in a relatively short period of several months or so. Therefore, the improvement in them is desired.

As one means for improving the light fastness of silver halide color photographic materials, known is addition of ultraviolet absorbents to the materials.

To add an ultraviolet absorbent to a photographic material, there are known a method of emulsifying and dispersing it in a high boiling point organic solvent, such as phthalates, phosphates, and adding the resulting dispersion to a photographic material, such as that described in JP-A 58-209735 (the term "JP-A" as used herein means an "unexamined published Japanese patent application"); and a method of infiltrating it into a polymer latex and adding the resulting latex to a photographic material, such as that described in British Patent 2,016,017A. However, these methods had various drawbacks in that the light fastness of the ultraviolet absorbent itself is worsened and a large amount of a polymer latex is needed.

On the other hand, a method of emulsifying and dispersing an ultraviolet absorbent along with a particular hydrophobic polymer and adding the resulting dispersion to a photographic material, by which the light fastness of the ultraviolet absorbent itself and also the color image formed is improved, has been disclosed in JP-A 63-264748 and 4-19185. According to this method, however, it was necessary to use a large amount of an auxiliary solvent so as to dissolve both the ultraviolet absorbent and the hydrophobic polymer. If a large amount of such an auxiliary solvent used remains in the emulsified dispersion, it often causes a problem in that the coated layer is uneven. If, on the other hand, the amount of the auxiliary solvent to be used for dissolving the polymer is reduced, the viscosity of the resulting solution will increase so that the solution is hardly emulsified and dispersed, or, as the case may be, the dispersibility of the emulsified dispersion will be poor so that the dispersion contains coarse grains or it often gives precipitates when stored.

Apart from the above, various attempts have been made so as to prevent photographic images from having yellow stains in their white background areas when exposed to light, by adding various stain inhibitors to photographic materials. For instance, JP-B 51-1420 (the term "JP-B" as used herein means an "examined Japanese patent publication") and 52-6623, JP-A 58-114036 and 59- 5246 mention that phenols, amides, piperidines and hydrazines are effective in preventing stains when used along with couplers. It was sure that the proposed technique was effective in noticeably preventing stains to be derived from couplers. However, the technique was not satisfactory since it was ineffective in preventing stains to be derived from non-light-sensitive layers. Therefore, the improvement in the technique has been desired.

SUMMARY OF THE INVENTION

Accordingly, the first object of the present invention is to provide a silver halide color photographic material having high light fastness. The second object of the present invention is to provide a silver halide color photographic material having improved light fastness, without using a large amount of an auxiliary solvent for emulsifying and dispersing.

These objects of the present invention are attained by a silver halide color photographic material having, on a support, an yellow-coloring silver halide emulsion layer, a magenta-coloring silver halide emulsion layer, a cyan-coloring silver halide emulsion layer and at least one non-coloring layer, in which said non-coloring layer contains at least one water-insoluble polymer having a number average molecular weight of less than 2000 which is obtained by polymerizing at least one monomer having an aromatic group.

As one embodiment of the present invention, the silver halide color photographic material further contains, in said non-coloring layer, compound(s) of a general formula (I), (II) or (III):

[I]

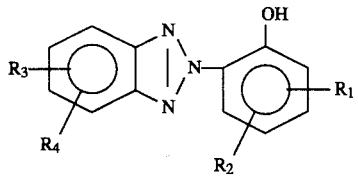

[II]

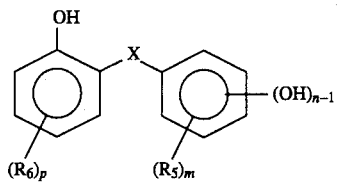

[III]

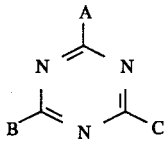

In formula (I), $R_1$ to $R_4$ each represent a hydrogen atom, a halogen atom, a nitro group, a hydroxyl group, an alkyl group, an alkoxy group, an aryl group, an aryloxy group, an acylamino group, a carbamoyl group, a sulfo group, an alkylthio group or an arylthio group; and $R_1$ and $R_2$, and $R_3$ and $R_4$ each may be bonded to each other to form a ring. In formula (II), $R_5$ and $R_6$ each represent a hydrogen atom, an alkyl group or an acyl group; X represents —CO— or —COO—; and n represents an integer of from 1 to 4, m represents an integer of 1 to 5, and p represents an integer of 1 to 4. These substituents in formulae (I) and (II) may optionally be substituted by other substituents.

In formula (III), A, B and C each independently represent a substituted or unsubstituted alkyl, aryl, alkoxy, aryloxy or heterocyclic group, provided that at least one of A, B and C is a group of a general formula (IV):

[IV]

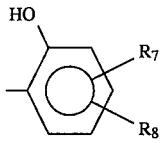

In formula (IV), $R_7$ and $R_8$ each independently represent a hydrogen atom, a halogen atom, or a substituted or unsubstituted alkyl, aryl, alkoxy or aryloxy group.

As another embodiment of the present invention, the silver halide color photographic material further contains, in said non-coloring layer, at least one high boiling point organic solvent having a refractive index of 1.50 or less.

As still another embodiment of the present invention, said water-insoluble polymer in the silver halide color photographic material is a polymer having a number average molecular weight of less than 2000 and having, as the constitutive monomer, at least one of styrene, α-methylstyrene and β-methylstyrene.

DETAILED DESCRIPTION OF THE INVENTION

The reasons why the polymer having the defined structure and the defined mean molecular weight to be used in the present invention can improve the light fastness of the color image to be formed on the photographic material of the present invention prevent stains in the white background area in the color image when exposed to light are not clear, but it may be presumed that the polymer is highly compatible with ultraviolet absorbents so that it can improve the light fastness of ultraviolet absorbents to thereby make them exhibit their ultraviolet-cutting effect for a long period of time and that the polymer inhibits the photolysis of the color mixing preventing agent contained in the non-coloring layer.

The present invention will be described in detail hereunder.

The polymer for use in the present invention is a polymer which has, as its constitutive element, at least one, aromatic group-containing monomer unit and which is substantially insoluble in water, and this has a number average molecular weight of less than 2000. The wording "substantially insoluble in water" means that the solubility of the polymer in 100 g of water at 25° C. is 1.0 g or less. In view of the object of improving the light fastness of the photographic image to be formed on the photographic material of the present invention and the object of improving the dispersion stability of the emulsion of the polymer, it is desirable that the polymer has a number average molecular weight of from 200 to less than 2000, more preferably from 200 to 1000 or less. If the number average molecular weight is less than the defined range, the light fastness of the photographic image to be formed on the photographic material of the present invention will be unsatisfactory. On the contrary, however, if it is more than 2000, the dispersion stability of the polymer will be deteriorated.

The polymer for use in the present invention may be either a so-called homopolymer composed of one monomer, or a copolymer composed of two or more monomers. In the latter case, it is preferred that the copolymer contains 20% by weight or more of the monomer having an aromatic group defined by the present invention.

The structure of the polymer for use in the present invention is not specifically defined, provided that it satisfies the above-mentioned requirement. However, as preferred structures of the polymer, mentioned are polymers composed of monomer(s) selected from styrene, α-methylstyrene, β-methylstyrene and their derivatives having substituent(s) on the benzene ring thereof; and polymers composed of monomer(s) selected from aromatic acrylamides, aromatic methacrylamides, aromatic acrylates and aromatic methacrylates. The substituent on the benzene ring includes any groups which are capable of being substituted on the benzene ring, and preferably includes, for example, a halogen atom, an alkyl group, and an alkoxy group. The aromatic group as referred to herein includes, for example, a phenyl group, a naphthyl group, a benzyl group, a biphenyl group, etc. The aromatic group may optionally be substituted by alkyl group(s), halogen atom(s), etc.

As comonomers for the copolymer, for example, preferably used are those described in JP-A 63-264748.

In view of the easiness in obtaining the raw materials of the polymer and of the time-dependent stability of the emulsion of the polymer during storage, preferred are polymers to be derived from styrene, α-methylstyrene or β-methylstyrene.

Specific examples of the polymer for use in the present invention are mentioned below, which, however, are not limitative. In these examples, l, m and n may be any number, provided that the polymer has a number average molecular weight of less than 2000.

P-1

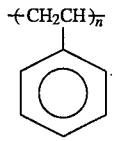

P-2

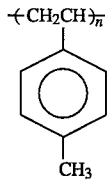

P-3

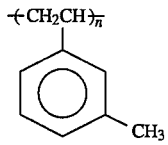

P-4

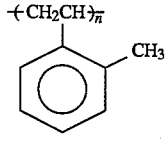

-continued
P-5
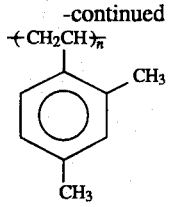
P-6
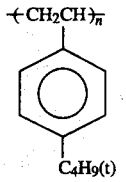
P-7
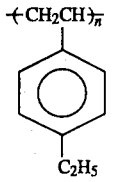
P-8
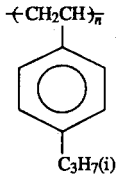
P-9
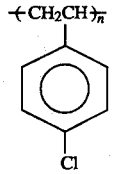
P-10
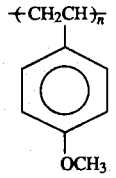
P-11
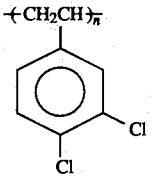
P-12
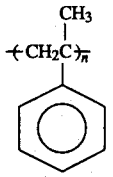
-continued
P-13
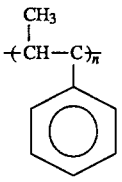
P-14
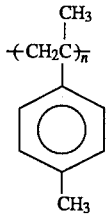
P-15
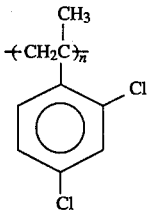
P-16
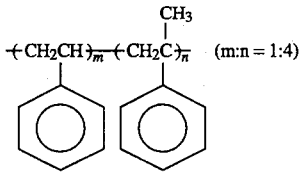
P-17
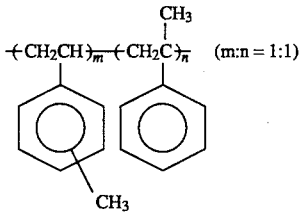
P-18
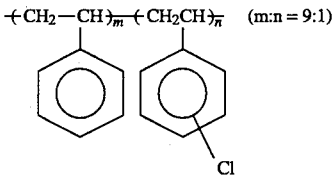
P-19
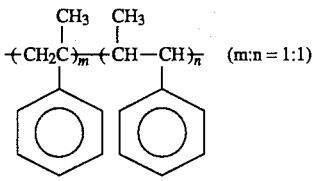
P-20
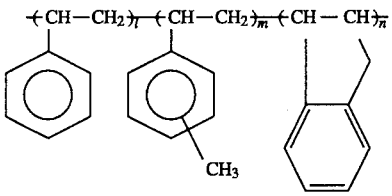

-continued

P-21

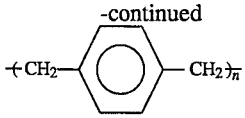

P-22

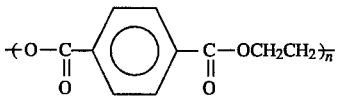

P-23

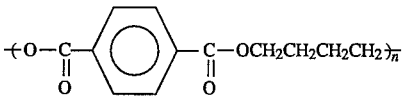

P-24

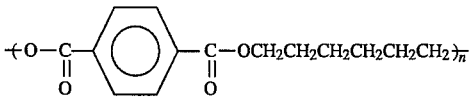

P-25

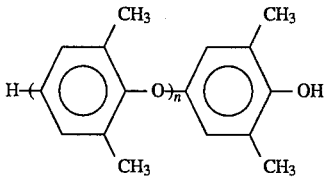

P-26

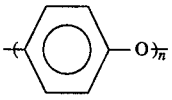

P-27

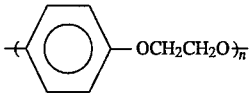

P-28

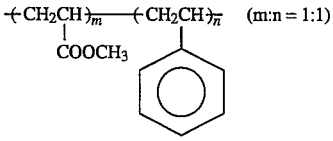

P-29

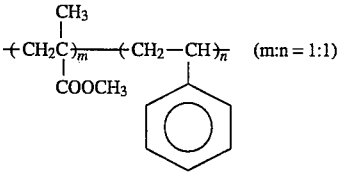

P-30

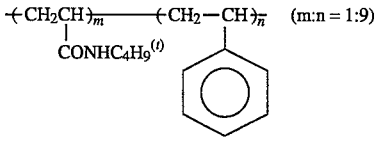

P-31

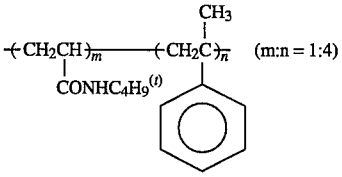

P-32

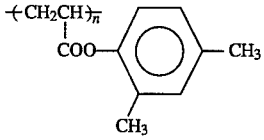

-continued

P-33

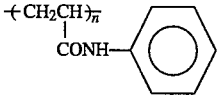

P-34

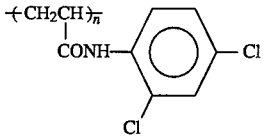

P-35

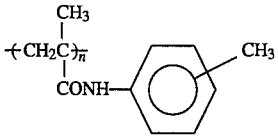

P-36

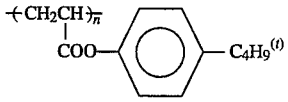

P-37

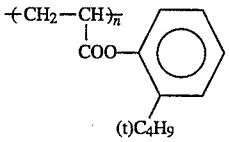

In the photographic material of the present invention, the amount of the polymer used in the non-light-sensitive layer is preferably from 0.01 to 3.00 g, more preferably from 0.02 to 1.50 g, much more preferably from 0.05 to 1.00 g, per $m^2$ of the material. Where the photographic material of the present invention has plural non-light-sensitive layers, the above-mentioned amount of the polymer may be divided and distributed to the layers. To add the polymer to the non-light-sensitive layer in the photographic material of the present invention, any known method may be employed. Preferably, the polymer is dissolved in a high-boiling point organic solvent optionally along with an auxiliary solvent such as ethyl acetate or methyl ethyl ketone, the resulting solution is emulsified and dispersed in an aqueous solution containing an aqueous binder such as gelatin, and the resulting dispersion is coated on a support.

Next, the ultraviolet absorbents of formulae [I], [II] and [III] employable in the present invention are described hereunder.

In formula (I), $R_1$ to $R_4$ each represent a hydrogen atom, a halogen atom, a nitro group, a hydroxyl group, an alkyl group, an alkoxy group, an aryl group, an aryloxy group, an acylamino group, a carbamoyl group, a sulfo group, an alkylthio group or an arylthio group, in which an alkyl moiety has preferably 1 to 32 carbon atoms, and an aryl moiety preferably has 6 to 32 carbon atoms. $R_1$ and $R_2$, and $R_3$ and $R_4$ each may be bonded to each other to form a ring in formula (II), $R_5$ and $R_6$ each represent a hydrogen atom, an alkyl group or an acyl group in which an alkyl moiety preferably has 1 to 32 carbon atoms; X represents —CO— or —COO—; and n represents an integer of from 1 to 4. These substituents in formulae (I) and (II) may optionally be substituted by other substituents. 2-( 2'-hydroxyphenyl)benzotriazole-type ultraviolet absorbents of formula (I) for use in the present invention may be either solid or liquid at room temperature. Specific examples of liquid ultraviolet absorbents of this type are described in JP-B 55-36984, 55-12587, JP-A 58- 214152, etc. The details of the atoms and the groups of $R_1$ to $R_4$ in the ultraviolet absorbents of formula (I) are described in JP-A 58-221844, 59-46646, 59-109055, JP-B 36- 10466, 42-26187, 48-5496, 48-41572, U.S. Pat. Nos. 3,754,919, 4,220,711, etc. The details of the groups of $R_5$ and $R_6$ in the benzophenone-type ultraviolet absorbents of formula (II) are described in JP-B 48-30493 (U.S. Pat. No. 3,698,907) and 48-31255.

In formula (III), A, B and C each independently represent a substituted or unsubstituted alkyl group having 1 to 20 carbon atoms, and a substituted or unsubstituted aryl, alkoxy, aryloxy or heterocyclic (e.g., pyridyl) group in which alkyl moiety preferably has 1 to 32 carbon atoms and aryl moiety preferably has 6 to 32 carbon atoms. As the substituents for these groups, mentioned are a hydroxyl group, a halogen atom (e.g., fluorine, chlorine, bromine, etc.), an alkyl group having from 1 to 12 carbon atoms (e.g., methyl, ethyl, butyl, trifluoromethyl, hydroxyoctyl, epoxymethyl), an alkoxy group having from 1 to 18 carbon atoms (e.g., methoxy, ethoxy, butoxy, cyclohexyloxy, benzyloxy, etc.), an aryloxy group having from 6 to 18 carbon atoms (e.g., phenoxy, m-methylphenoxy, etc.), an alkoxycarbonyl group (e.g., ethoxycarbonyl, 2-methoxyethoxycarbonyl, etc.), an aryloxycarbonyl group (e.g., phenoxycarbonyl, p-methylphenoxycarbonyl, etc.), an alkylthio group having from 1 to 18 carbon atoms (e.g., methylthio, butylthio, etc.), a carbamoyl group (e.g., methylcarbamoyl, butylcarbamoyl, etc.), etc.

Of the groups of A, B and C, others than the group of the above-mentioned formula (IV) each are preferably a substituted or unsubstituted aryl or alkoxy group.

In formula (IV), $R_7$ and $R_8$ each independently represent a hydrogen atom, a halogen atom (e.g., fluorine, chlorine, bromine, etc.), a substituted or unsubstituted alkyl group having from 1 to 18 carbon atoms (e.g., methyl, trifluoromethyl, cyclohexyl, glycidyl, etc.), a substituted or unsubstituted aryl group having from 6 to 18 carbon atoms (e.g., phenyl, tolyl, etc.), a substituted or unsubstituted alkoxy group having from 1 to 20 carbon atoms (e.g., methoxy, butoxy, 2-butoxyethoxy, 3-butoxy-2-hydroxypropyloxy, etc.), or a substituted or unsubstituted aryloxy group having from 6 to 18 carbon atoms (e.g., phenoxy, p-methylphenoxy, etc.).

Preferably, R7 and R8 each are a substituted or unsubstituted alkoxy group having from 1 to 20 carbon atoms, which is bonded to the benzene ring preferably at the para-position relative to the carbon atom bonded to the triazine ring.

Compounds of formula (III) for use in the present invention may be produced in accordance with the methods described in JP-A 46-3335 and European Patent No. 520938A1.

Specific examples of the ultraviolet absorbents for use in the present invention are mentioned below, which, however, are not limitative.

Compounds of formula (I):

| No. | Rc | Ra | Rb |
|---|---|---|---|
| | 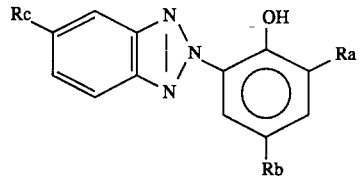 | | |
| I-1 | H | H | $-C_4H_9(t)$ |
| I-2 | H | H | $-C_{12}H_{25}(n)$ |
| I-3 | H | H | $-CH_2CH_2COOC_8H_{17}$ |
| I-4 | Cl | H | $-C_8H_{17}(t)$ |
| I-5 | Cl | H | $-CH_2CH_2COOC_8H_{17}$ |
| I-6 | H | $-C_4H_9(sec)$ | $-C_4H_9(t)$ |
| I-7 | H | $-C_5H_{11}(t)$ | $-C_5H_{11}(t)$ |
| I-8 | H | $-C_4H_9(t)$ | $-CH_2CH_2COOC_8H_{17}$ |
| I-9 | H | $-CH_3$ | $-C_4H_9(t)$ |
| I-10 | Cl | $-C_4H_9(t)$ | $-C_4H_9(t)$ |
| I-11 | Cl | $-C_4H_9(sec)$ | $-C_4H_9(t)$ |
| I-12 | Cl | $-C_4H_9(t)$ | $-CH_2CH_2COOC_8H_{17}$ |
| I-13 | $-OCH_3$ | $-C_4H_9(sec)$ | $-C_4H_9(t)$ |
| I-14 | $-C_4H_9(sec)$ | $-C_4H_9(t)$ | $-CH_2CH_2COOC_8H_{17}$ |
| I-15 | $-C_6H_5$ | $-C_5H_{11}(t)$ | $-C_5H_{11}(t)$ |
| I-16 | H | $-C_{12}H_{25}(n)$ | $-CH_3$ |
| | 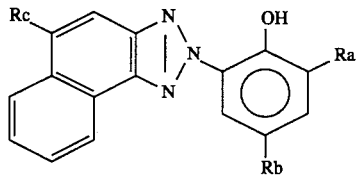 | | |
| I-17 | H | $-C_4H_9(t)$ | $-C_4H_9(t)$ |
| I-18 | H | H | $-CH_2CH_2COOC_8H_{17}$ |
| I-19 | $-OCH_3$ | $-C_{12}H_{25}(n)$ | $-CH_3$ |
| I-20 | Cl | $-C_4H_9(t)$ | $-CH_2CH_2COOC_8H_{17}$ |

Compounds of formula (II):

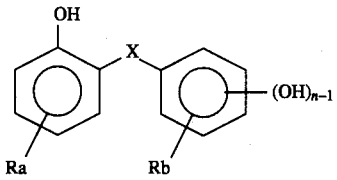

| No. | $X_3$ | Ra | Rb | n-(OH) |
|---|---|---|---|---|
| II-1 | —CO— | $5\text{-}OC_4H_9$ | H | 1 |
| II-2 | " | $5\text{-}OC_8H_{17}$ | H | 1 |
| II-3 | " | $5\text{-}OC_{16}H_{33}$ | H | 1 |
| II-4 | " | $5\text{-}OC_{18}H_{37}$ | H | 1 |
| II-5 | " | $4\text{-}OC_4H_9$ | $4'\text{-}CH_3$ | 3 2'-, 5'- |
| II-6 | " | $5\text{-}COCH_3$ | $3'\text{-}C_8H_{17}$ | 3 2'-, 6'- |
| II-7 | " | $5\text{-}C_{12}H_{25}$ | $4'\text{-}COCH_3$ | 2 2'-, |

-continued
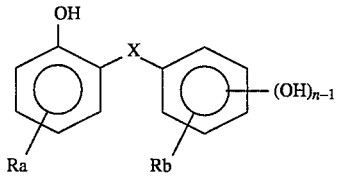
| No. | $X_3$ | Ra | Rb | n-(OH) |
|---|---|---|---|---|
| II-8 | " | 5-$COCH_3$ | 3'-$C_8H_{17}$ | 3 2'-, 6'- |
| II-9 | " | 4-$OC_{12}H_{25}$ | 4'-$OCH_2C_6H_4$-(p)$CH_3$ | 2 2'- |
| II-10 | " | 5-$C_8H_{17}$ | 4'-$COC_6H_4$-(p)$CH_3$ | 3 2'-, 6'- |
| II-11 | —COO— | 4-$C_{12}H_{25}$ | 4'-$C_4H_9$(t) | 1 |
| II-12 | " | H | 4'-$C_4H_9$(t) | 1 |
| II-13 | " | 4-$OC_{12}H_{25}$ | 5'-$OCH_3$ | 2 2'- |
| II-14 | " | 3-$OCH_3$ | 5'-$OC_{12}H_{25}$ | 2 2'- |
III-1
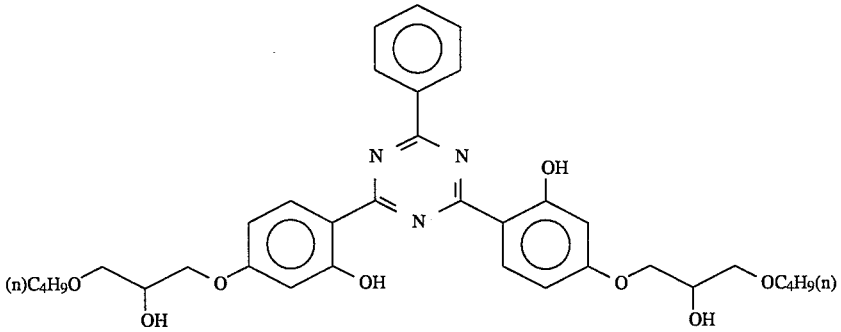
III-2
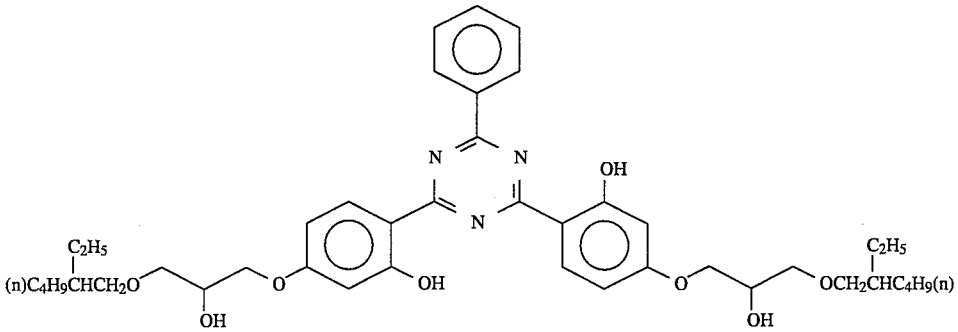
III-3
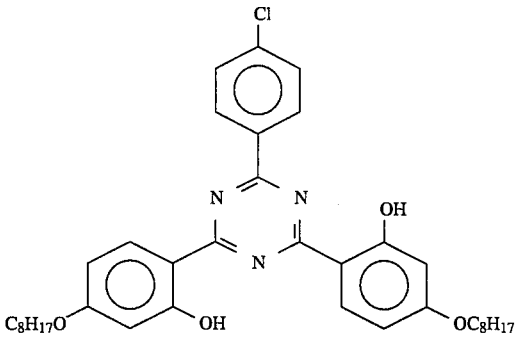

-continued
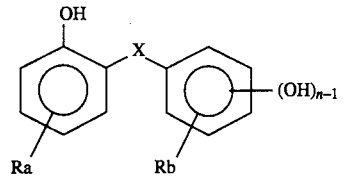
| No. | $X_3$ | Ra | Rb | n-(OH) |
|---|---|---|---|---|
| III-4 | 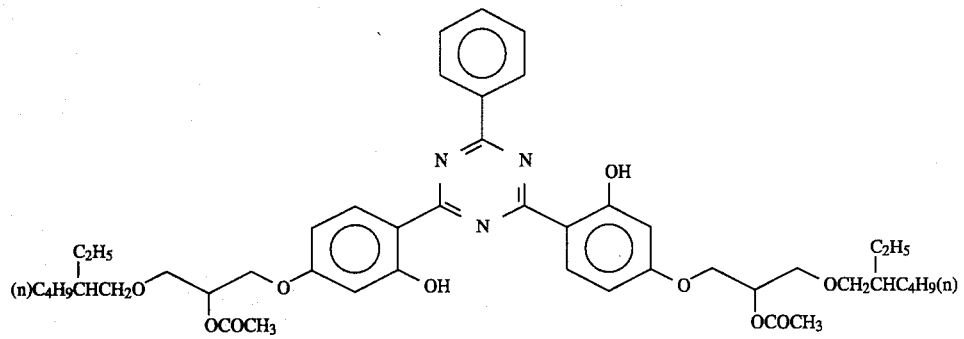 | | | |
| III-5 | 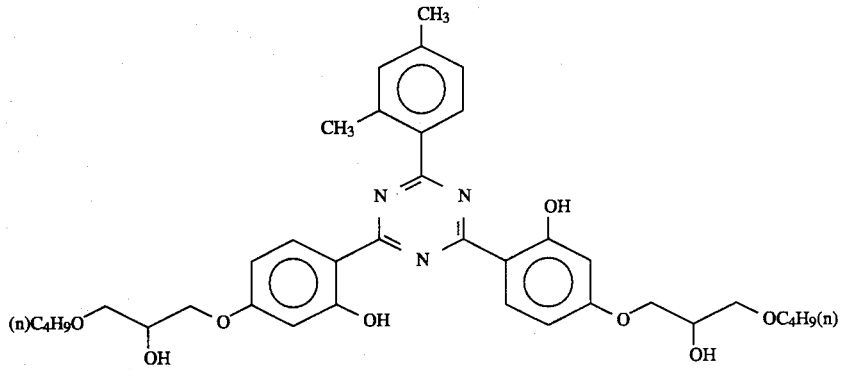 | | | |
| III-6 | 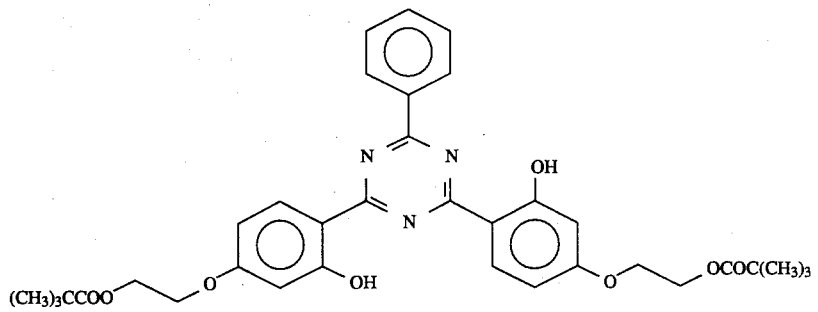 | | | |
| III-7 | 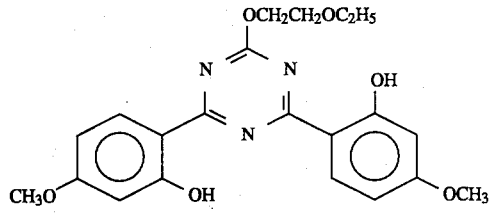 | | | |

-continued
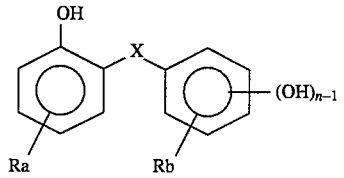
| No. | $X_3$ | Ra | Rb | n-(OH) |
|---|---|---|---|---|
| III-8 | 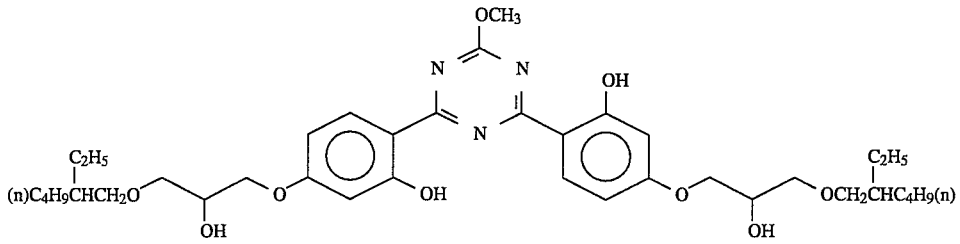 | | | |
| III-9 | 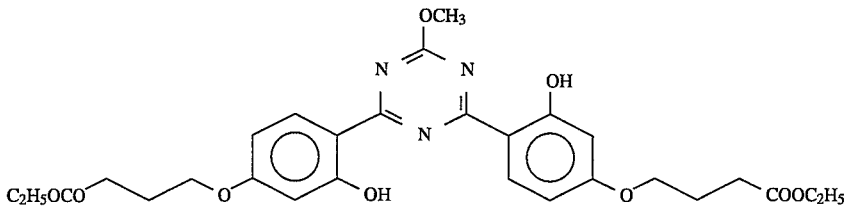 | | | |
| III-10 | 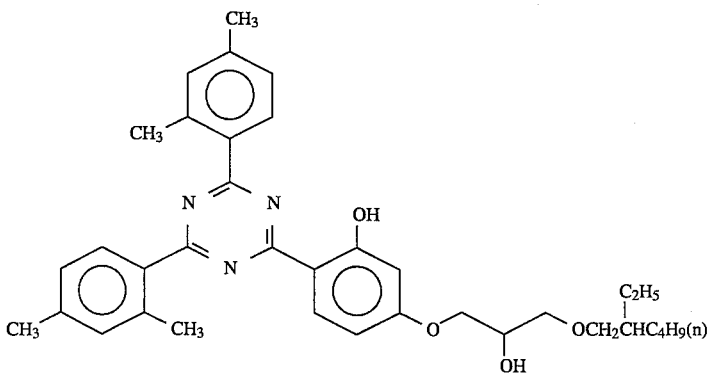 | | | |
| III-11 | 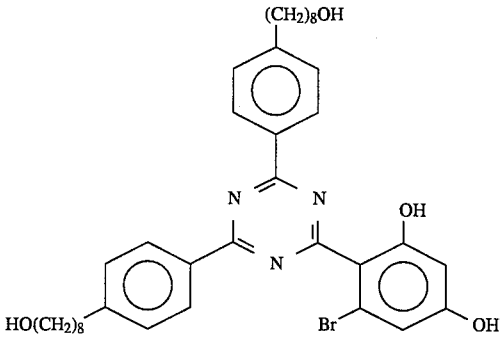 | | | |

-continued
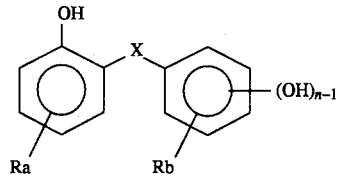
| No. | $X_3$ | Ra | Rb | n-(OH) |
|---|---|---|---|---|
| III-12 | 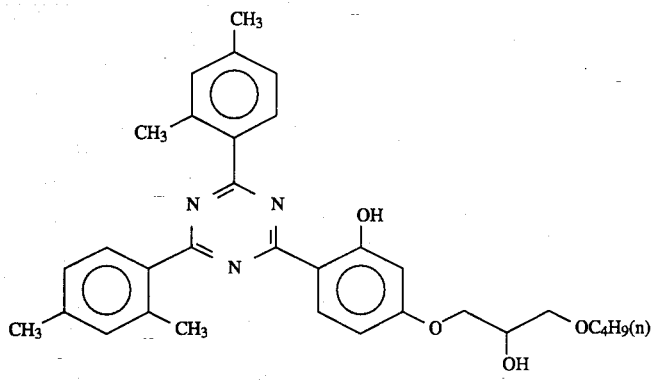 | | | |
| III-13 | 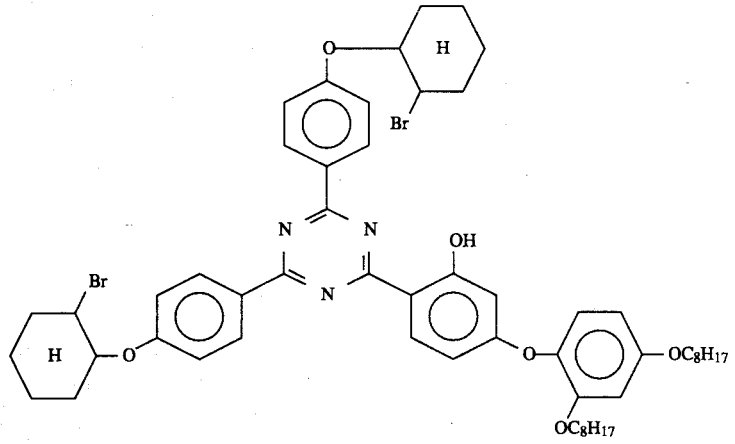 | | | |
| III-14 | 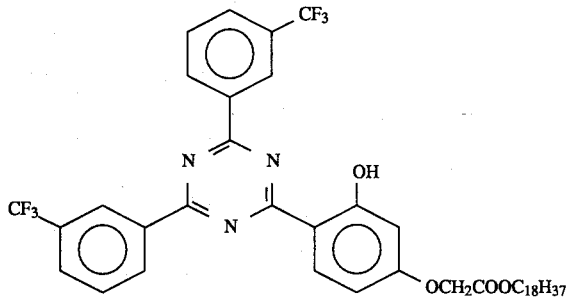 | | | |
| III-15 | 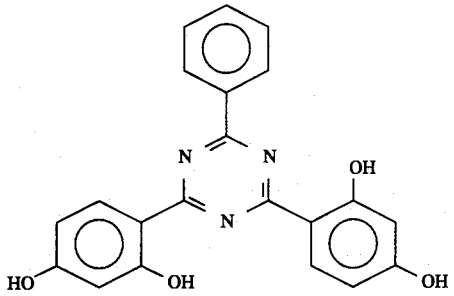 | | | |

-continued
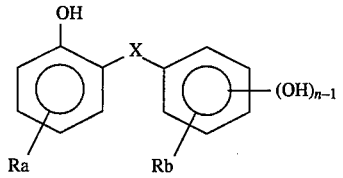
| No. | $X_3$ | Ra | Rb | n-(OH) |
|---|---|---|---|---|
| III-16 | 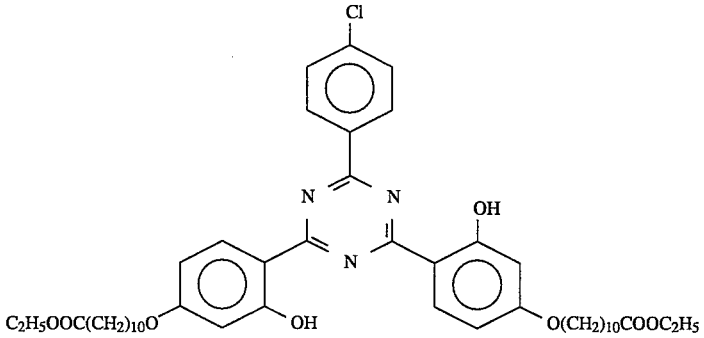 | | | |
| III-17 | 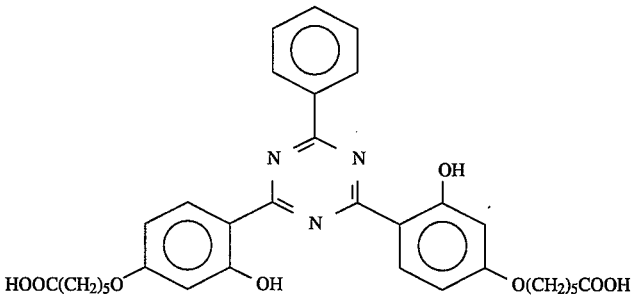 | | | |
| III-18 | 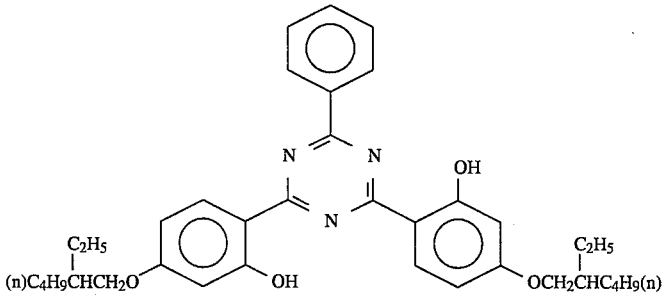 | | | |
| III-19 | 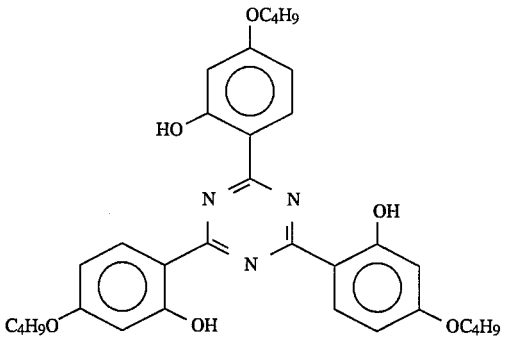 | | | |

-continued
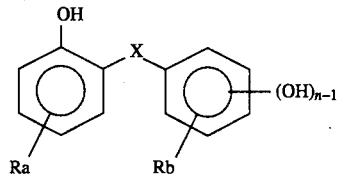
| No. | $X_3$ | Ra | Rb | n-(OH) |
|---|---|---|---|---|
| III-20 | 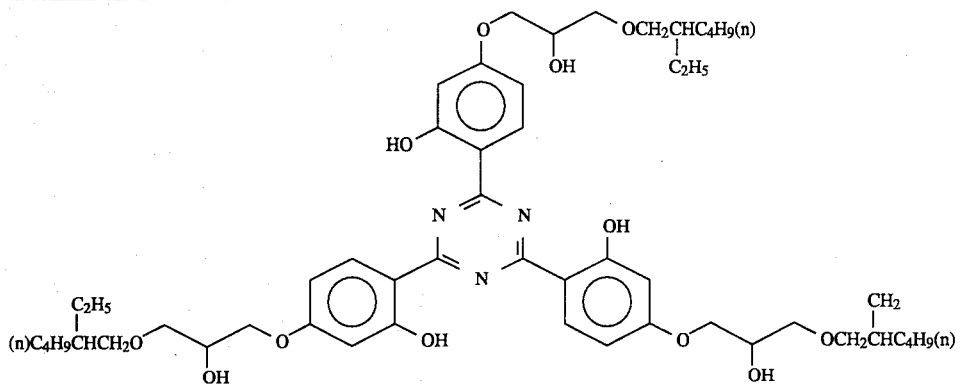 | | | |
| III-21 | 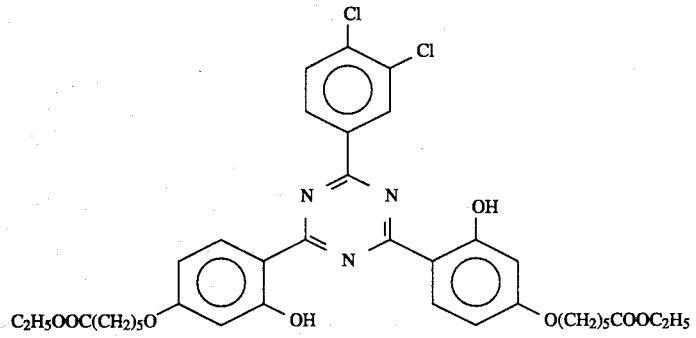 | | | |
| III-22 | 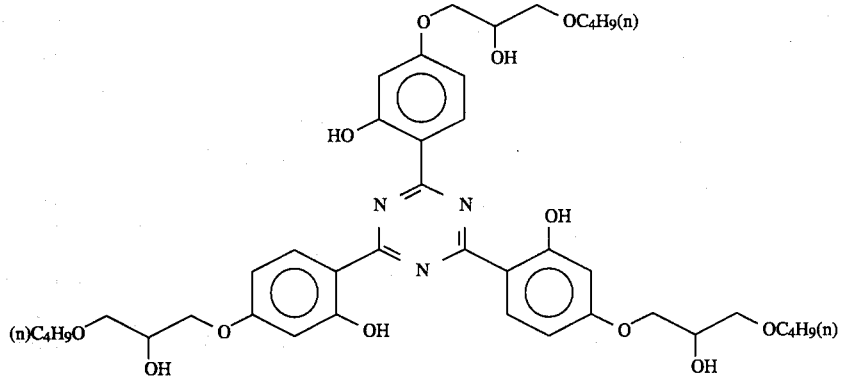 | | | |

-continued
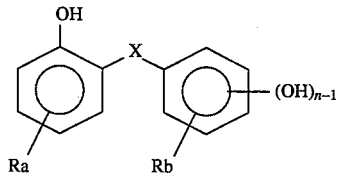
| No. | $X_3$ | Ra | Rb | n-(OH) |
|---|---|---|---|---|
| III-23 | 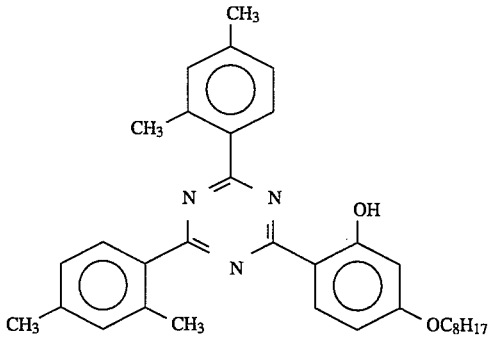 | | | |
| III-24 | 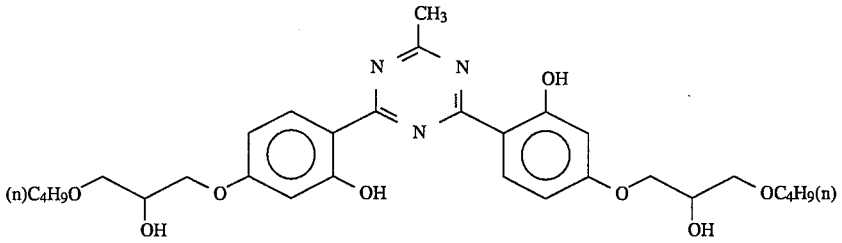 | | | |
| III-25 | 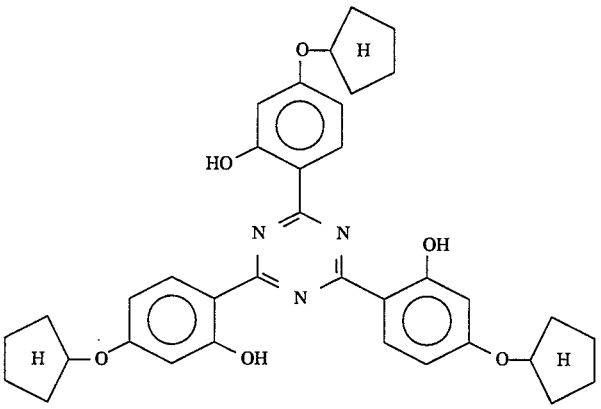 | | | |
| III-26 | 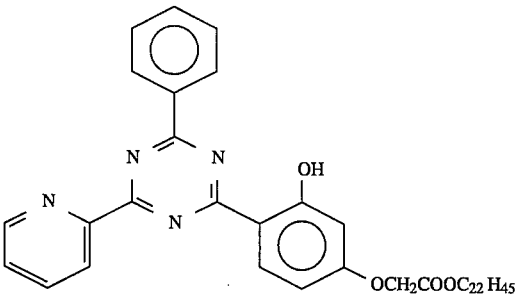 | | | |

-continued
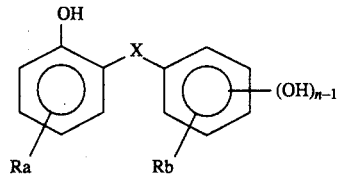
| No. | $X_3$ | Ra | Rb | n-(OH) |
|---|---|---|---|---|
| III-27 | 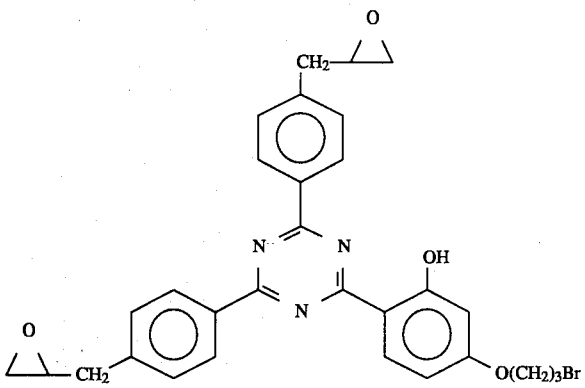 | | | |
| III-28 | 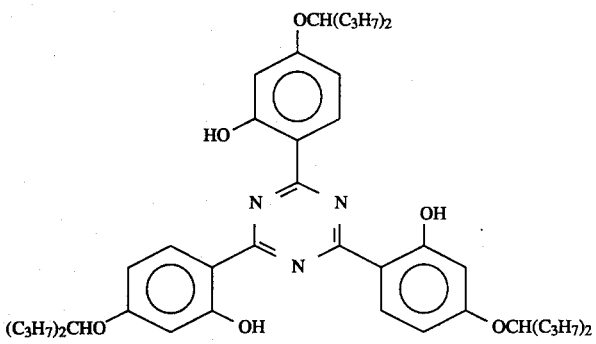 | | | |
| III-29 | 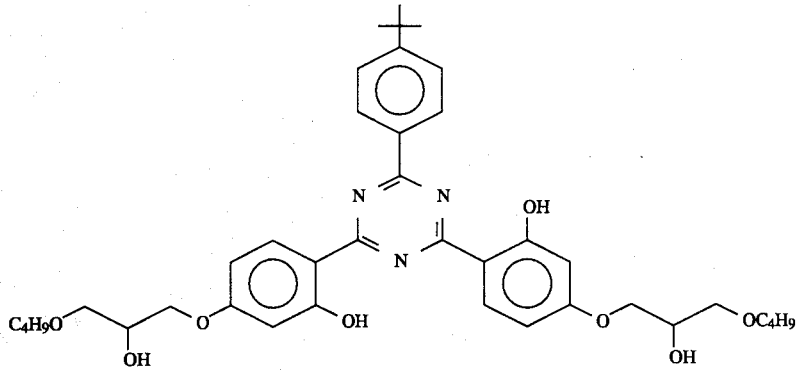 | | | |

-continued

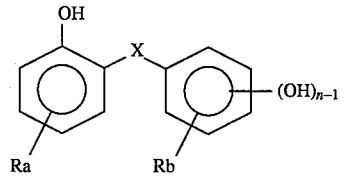

| No. | $X_3$ | Ra | Rb | n-(OH) |
|---|---|---|---|---|
| III-30 | 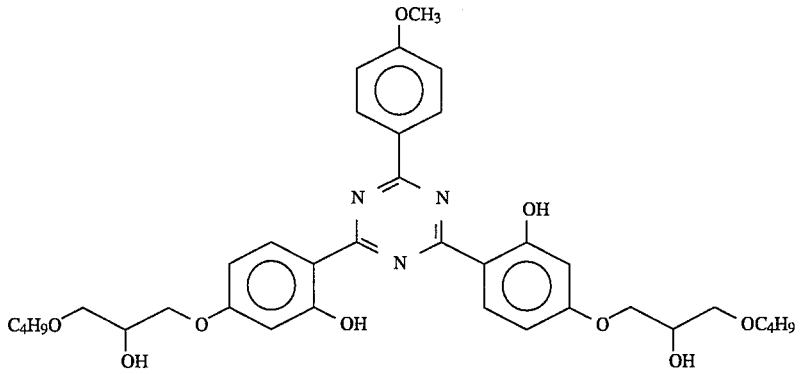 | | | |
| III-31 | 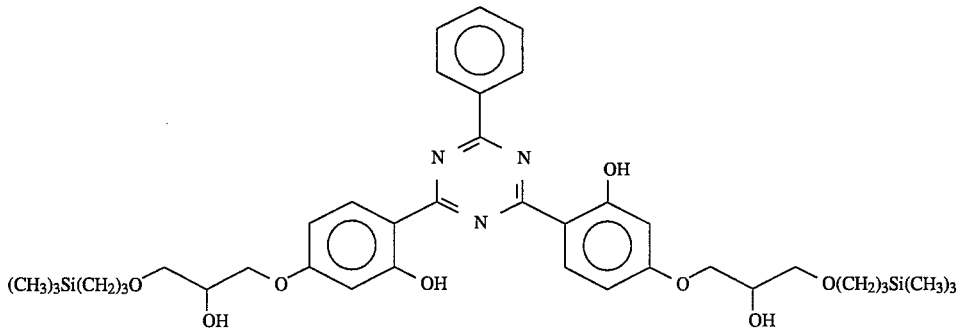 | | | |
| III-32 | 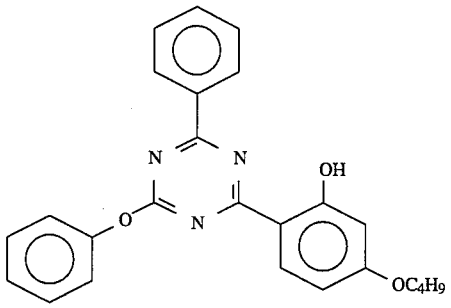 | | | |

In the photographic material of the present invention, it is preferred that the ultraviolet absorbent is added to the non-light-sensitive layer containing the polymer defined by the invention. More preferably, the ultraviolet absorbent is added to the upper layer overlying on the silver halide emulsion layer remotest from the support.

The compound of formula (I), (II) or (III) may be added to the photographic material of the present invention singly or along with any other ultraviolet absorbent having a different structure. Preferably, a mixture composed of two or more, more preferably three or more selected from the compounds of formulae (I), (II) and (III) are added. Much more preferably, at least one of them is liquid at room temperature.

Where the ultraviolet absorbents are dispersed using the water-insoluble polymer defined by the invention, the proportion of the polymer to the ultraviolet absorbents is preferably from 1 to 200% by weight, more preferably from 5 to 100% by weight, much more preferably from 5 to 50% by weight. The amount of the ultraviolet absorbents to be coated is preferably such that the absorbance at 360 nm of the photographic material containing them is 0.6 or more, more preferably 1.0 or more, much more preferably 1.5 or more. To disperse the ultraviolet absorbents, a high boiling point organic solvent may additionally be employed. High boiling point organic solvents usable in the case may be liquid, waxy or solid at room temperature but preferably have a boiling point of 180° C. or higher and a melting point of 150° C. or lower, preferably a boiling point of 200° C. or higher and a melting point of 100° C. or lower.

The high boiling point organic solvents for use in the present invention are not specifically defined, provided that they satisfy the above-mentioned requirements, but are preferably phosphates, phosphonates, benzoates, phthalates, fatty acid esters, carbonates, amides, ethers, halogeno-hydrocarbons, alcohols, paraffins, etc. Of these, especially preferred are phosphates, phosphonateso, phthalates, benzoates and fatty acid esters.

The ratio of the amount of the high boiling point organic solvents to the water-insoluble polymer is generally from 0 to 50, and preferably 0 to 20 by weight.

Where the high boiling point organic solvent is used together with the polymer and the ultraviolet absorbent(s) defined by the present invention, the refractive index of the high boiling organic point solvent to be used is preferably 1.50 or less, more preferably from 1.43 to 1.48.

This is because the phase containing the polymer defined by the invention may have a refractive index near to that of a binder such as gelatin with the result that so-called haze of the photographic material may be inhibited and the density in the yellow area having the maximum color density is hardly lowered.

Specific examples of preferred high boiling point organic solvent for use in the present invention are mentioned below, which, however, are not limitative.

| | | Refractive Index |
|---|---|---|
| S-1 | $P(=O)(OC_6H_{13})_3$ | 1.433 |
| S-2 | $P(=O)(OCH_2CH(C_2H_5)C_4H_9)_3$ | 1.4419 |
| S-3 | $P(=O)(OC_8H_{17})_3$ | 1.4408 |
| S-4 | $P(=O)(OCH_2CH_2CH(CH_3)CH_2C(CH_3)_3)_3$ | 1.447 |
| S-5 | $P(=O)(OC_{12}H_{25})_3$ | 1.4507 |
| S-6 | $(OCH_2CH(C_2H_5)C_4H_9)_2P(=O)OC_4H_9$ | 1.440 |
| S-7 | $C_8H_{17}P(=O)(OC_8H_{17})_2$ | 1.4477 |
| S-8 | 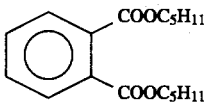 | 1.488 |

-continued

| | | Refractive Index |
|---|---|---|
| S-9 | 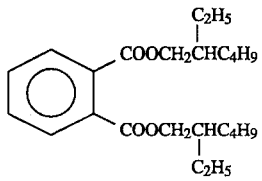 | 1.485 |
| S-10 | 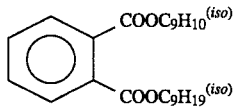 | 1.4810 |
| S-11 | 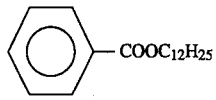 | 1.4832 |
| S-12 | 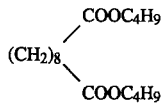 | 1.4391 |
| S-13 | 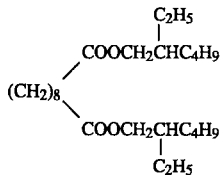 | 1.4491 |
| S-14 | 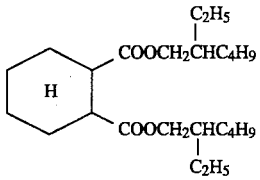 | 1.4611 |
| S-15 | 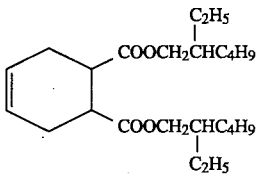 | 1.465 |
| S-16 | 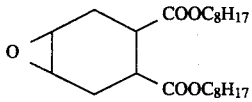 | 1.4648 |
| S-17 | 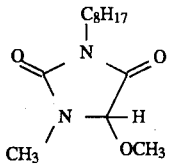 | 1.4637 |
| S-18 | $CH_2-OCOCH(C_2H_5)C_4H_9$<br>$CH-OCOCH(C_2H_5)C_4H_9$<br>$CH_2-OCOCH(C_2H_5)C_4H_9$ | 1.4442 |

-continued

| | | Refractive Index |
|---|---|---|
| S-19 | $C_8H_{17}-CH(O)-CH(CH_2)_7COOCH_2CH(C_2H_5)C_4H_9$ | 1.454 |
| S-20 | 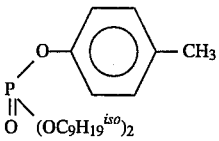 | 1.4564 |
| S-21 | 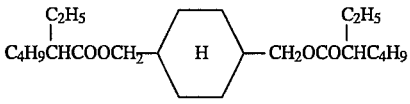 | 1.4548 |
| S-22 | 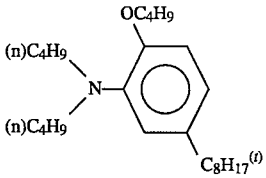 | 1.490 |
| S-23 | $CH_2=C(CH_2-COOCH_2CH(C_2H_5)C_4H_9)-COOCH_2CH(C_2H_5)C_4H_9$ | 1.4500 |
| S-24 | $C_8H_{17}O-C(=O)-OC_8H_{17}$ | 1.4385 |
| S-25 | $P-(OC_{12}H_{25})_3$ | 1.4554 |
| S-26 | $CH_2-COOC_4H_9$<br>$CH-COOC_4H_9$<br>$CH_2-COOC_4H_9$ | 1.433 |
| S-27 | $(CH_2)_4(COOCH_2CH(C_2H_5)C_4H_9)_2$ | 1.447 |
| S-28 | $C_{13}H_{27}COOCH_2CH(C_6H_{13})C_8H_{17}$ | 1.453 |
| S-29 | $CH_3CH(OH)COOC_{18}H_{37}^{(iso)}$ | 1.4493 |
| S-30 | 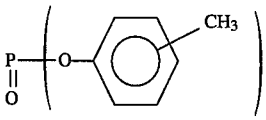 | 1.555 |
| S-31 | 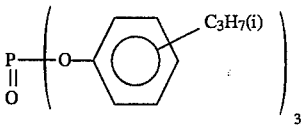 | 1.546 |

-continued

| | | Refractive Index |
|---|---|---|
| S-32 | 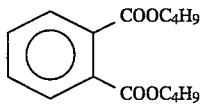 | 1.493 |

The color photographic material of the present invention comprises a support, and is composed of at least one yellow-coloring silver halide emulsion layer, at least one magenta-coloring silver halide emulsion layer and at least one cyan-coloring silver halide emulsion layer coated thereon. General color printing paper containing color couplers therein each capable of forming a dye complementary to the light to which the silver halide emulsion containing the color coupler is sensitive, are subjected to color reproduction by subtractive color photography. Such color printing paper has the above-mentioned coloring layers in said order on the support, in which the silver halide emulsion grains have been color-sensitized with blue-sensitizing, green-sensitizing and red-sensitizing dyes, respectively. However, the order of the coloring layers is not limited, and thus may be different from this. Namely, from the viewpoint of rapidly processing color printing papers, it is often preferred that a light-sensitive layer containing silver halide grains having the largest mean grain size is positioned uppermost; or from the viewpoint of improving the storability of them under light exposure, it is often preferred that a magenta-coloring light-sensitive layer is positioned lowermost.

In the relation between the light-sensitive layer and the developed color hue, the layer construction is not limited to only that mentioned above. If desired, the material may have at least one infrared-sensitive silver halide emulsion layer.

The support of the color photographic material of the present invention may be any one on which photographic emulsion layers can be coated, such as glass, paper, plastic films, etc. Most preferred is a reflective support.

The "reflective support" usable in the present invention is one capable of elevating the reflectivity of the photographic material to much sharpen the color image as formed in the silver halide emulsion layer in the material. Such a reflective support includes one as prepared by coating on a support a hydrophobic resin which is dispersed therein a photo-reflecting substance, such as titanium oxide, zinc oxide, calcium carbonate or calcium sulfate; and one as formed from a hydrophobic resin itself which is dispersed therein the above-mentioned photo-reflective substance. For instance, there are mentioned polyethylene-coated papers; polyethylene terephthalate coated papers; polypropylenic synthetic papers; and transparent supports having a reflective layer or using a reflective substance (e.g., glass plate, polyester films such as polyethylene terephthalate, cellulose triacetate or cellulose nitrate film, polyamide films, polycarbonate films, polystyrene films, vinyl chloride resin films). As the reflective support for use in the present invention, preferred is a paper support, of which the both surfaces have been coated with a water-proof resin layer and in which at least one of the coated water-proof resin layers contains fine grains of a white pigment. It is preferred that the density of these fine grains of a white pigment in the layer(s) is 12% by weight or more, more preferably 14% by weight or more. To add the fine grains of a white pigment to the layer(s), it is preferred that the grains are fully kneaded with a water-proof resin in the presence of a surfactant. In addition, it is also preferred to use fine grains of a white pigment, of which the surfaces have been treated with a dihydric to tetrahydric alcohol.

It is preferred that the fine grains of a white pigment are uniformly dispersed in the reflective layer without forming their aggregates. The distribution of the fine grains in the layer can be obtained by measuring the exclusive area ratio (%) (Ri) of the fine grains to be projected in the unit area of the layer. The fluctuation coefficient of the exclusive area ratio (%) of the fine grains can be obtained as the ratio of the standard deviation (s) of Ri to the mean value (R) of Ri, of s/R. In the present invention, the fluctuation coefficient of the exclusive area ratio (%) of the fine grains of a white pigment is preferably 0.15 or less, more preferably 0.12 or less, especially preferably 0.08 or less.

In the present invention, it is preferred to employ a support having a surface of second-kind diffusive reflectivity. The second-kind diffusive reflectivity as referred to herein means such diffusive reflectivity that is obtained by toughening a mirror surface to divide it into fine mirror surfaces each facing in different directions, thereby dispersing the orientations of the faces of the thus-divided fine mirror surfaces. The roughness of the surface of second-kind diffusive reflectivity is such that the three-dimensional mean roughness relative to the center plane is from 0.1 to 2 μm, preferably from 0.1 to 1.2 μm. The frequency of the roughness of the surface is preferably from 0.1 to 2000 cycle/mm, more preferably from 50 to 600 cycles/mm, for the rough surface having a roughness of 0.1 μm or more. The details of the support of this kind are described in JP-A 2-239244.

As the silver halide grains for use in the present invention, preferred are silver chloride, silver chlorobromide or silver chloroiodobromide grains having a silver chloride content of 95 mol% or more. Especially preferred are silver chlorobromide or silver chloride grains substantially not containing silver iodide, in order to accelerate the developing time for processing the photographic material. Silver halide grains substantially not containing silver iodide as referred to herein means those having a silver iodide content of 1 mol% or less, preferably 0.2 mot% or less. On the other hand, in order to increase the high intensity sensitivity, to increase the color-sensitized sensitivity or to improve the storage stability of the photographic material, high-silver chloride grains containing from 0.01 to 3 mol% of silver iodide on their surfaces, such as those described in JP-A 3-84545 are also preferably used, as the case may be. Regarding the halogen composition of grains of constituting an emulsion for use in the present invention, the grains may have different halogen compositions. Preferably, the emulsion contains grains each having the same halogen composition, as the property of the grain-inside may easily be homogenized. Regarding the halide composition distribution of the grain-inside of constituting a silver halide emulsion for use in the present invention, the grain may have a so-called uniform halogen composition structure where any part of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition part (for example, when such a non-layered different halogen composition part is on the surface of the grain, it may be on the edge, corner or plane of the grain as a conjugated structure). Any of such halogen compositions may properly be selected. In order to obtain a high sensitivity photographic material, the latter laminate or composite halogen composition structure grains are advantageously employed, rather than the former uniform halogen composition structure grains. Such laminate or composite halogen composition structure grains are also preferred in view of pressure resistance. In the case of laminate or composite halogen composition structure grains, the boundary between the different halogen composition parts may be a definite one or may also be an indefinite one because of forming a mixed crystal structure. If desired, the boundary between them may positively have a continuous structure variation.

The high-silver chloride grains for use in the present invention are preferably those having layered or non-layered, localized phases of silver bromide in the inside and/or on the surface of the silver halide grain, in the manner as mentioned above. The halide composition in the localized phase is preferably such that the phase has a silver bromide content of at least 10 mol%, more preferably higher than 20 mol%. The silver bromide content in the localized phase may be analyzed by X-ray diffraction (for example, described in *Lecture on New Experimental Chemistry,* No. 6, Analysis of Structure, edited by Japan Chemical Society, published by Maruzen Publishing Co.). The localized phase may be in the inside of the grain and/or on the edges, corners and/or planes of the surface of the grain. As one preferred example, mentioned is an embodiment where the localized phase has grown on the corners of the grain by epitaxial growth.

In order to reduce the amount of the replenisher to the developer to be used in processing the photographic material of the present invention, it is effective to further increase the silver chloride content in the silver halide emulsions constituting the material. In this case, preferably used are almost pure silver chloride emulsions, such as a silver chloride emulsion having a silver chloride content of from 98 mol% to 100 mol%.

The silver halide grains of constituting the silver halide emulsion of the present invention may have a mean grain size of preferably from 0.1 μm to 2 μm. (The grain size indicates a diameter of a circle having an area equivalent to the projected area of the grain, and the mean grain size indicates a number average value to be obtained from the measured grain sizes.)

Regarding the grain size distribution of the emulsion, a so-called monodispersed emulsion having a fluctuation coefficient (to be obtained by dividing the standard deviation of the grain size distribution by the mean grain size) of being 20% or less, preferably 15% or less, more preferably 10% or less is preferred. For the purpose of obtaining a broad latitude, two or more monodispersed emulsions may be blended to form a mixed emulsion for one layer, or they may be separately coated to form plural layers. Such blending or separate coating is preferably effected for this purpose.

Regarding the shape of the silver halide grains of constituting the photographic emulsion of the present invention, the grains may be regular crystalline ones such as cubic, tetradecahedral or octahedral crystalline ones, or irregular crystalline ones such as spherical or tabular crystalline ones, or may be composite crystalline ones composed of such regular and irregular crystalline ones. Mixtures of grains having different crystal forms may also be used in the present invention. Of these, preferred are mixtures containing the above-mentioned regular crystalline grains in a proportion of 50% or more, preferably 70% or more, more preferably 90% or more. Apart from these, silver halide emulsions containing tabular grains having a mean aspect ratio (circle-corresponding diameter/thickness) of 5 or more, preferably 8 or more, in a proportion of 50% or more of the total grains in terms of their projected areas are also preferably used in the present invention.

The silver (bromo)chloride emulsions for use in the present invention may be prepared, for example, by the methods described in P. Glafkides, *Chemie et Phisique Photographique* (published by Paul Morttel, 1967); G. F. Duffin, *Photographic Emulsion Chemistry* (published by Focal Press, 1966); and V. L. Zelikman et al., Making and Coating Photographic Emulsion (published by Focal Press, 1964). Briefly, they may be prepared by any of acid methods, neutral methods and ammonia methods. As the system of reacting soluble silver salts and soluble halides, employable is any of a single jet method, a double jet method and a combination of them. Also employable is a so-called reversed mixing method where silver halide grains are formed in an atmosphere having excess silver ions. As one system of a double jet method, employable is a so-called controlled double jet method, in which the pAg in the liquid phase where silver halide grains are being formed is kept constant. According to this method, silver halide emulsions comprising regular crystalline grains having nearly uniform grain sizes may be obtained.

It is preferred that the localized phase or the base of the silver halide grain of the present invention contains heterologous metal ions or complex ions. As preferred metal ions for this use, mentioned are metal ions belonging to the Group VIII and the Group IIb of the Periodic Table and their complexes, as well as lead ion and thallium ion. Specifically, the localized phase may contain ions chosen from among iridium ion, rhodium ion and iron ions and their complex ions while the base may contain ions chosen from among osmium ion, iridium ion, rhodium ion, platinum ion, ruthenium ion, palladium ion, cobalt ion, nickel ion and iron ion and their complex ions, optionally as combined. The localized phase and the base in one grain may have different contents of different metal ions. They may contain a plurality of such metal ions and complex ions. In particular, it is preferred that the localized phase of silver bromide contains iron and iridium compounds.

Compounds donating such metal ions may be incorporated into the localized phase and/or the other part (base) of the silver halide grains of the present invention, for example, by adding the compound to an aqueous gelatin solution which is to be a dispersing medium, or to an aqueous halide solution, an aqueous silver salt solution or other aqueous solutions at the step of forming the silver halide grains, or in the form of fine silver halide grains containing the metal ions which are dissolved in the system from which the silver halide grains are formed.

The incorporation of the metal ions into the silver halide grains of the present invention may be effected before, during or just after the formation of the grains. The time when the incorporation is effected may be determined, depending on the position of the grain into which the metal ion shall be incorporated.

The silver halide emulsions for use in the present invention is generally subjected to chemical sensitization and color sensitization.

The chemical sensitization includes, for example, chalcogen sensitization using a chalcogen sensitizing agent (such as typically sulfur sensitization using unstable sulfur compounds, selenium sensitization using selenium compounds, tellurium sensitization using tellurium compounds), noble metal sensitization (such as typically gold sensitization) and reduction sensitization, which may be employed singly or as combined. As the compounds to be used for such chemical sensitization, for example, preferred are those described in JP-A 62-215272, from page 18, right lower column to page 22, right upper column.

To more effectively attain the effect of the present invention, gold-sensitized, high-silver chloride emulsions are used in the present invention. The emulsions to be used in the present invention are so-called surface latent-type emulsions which form latent images essentially on the surfaces of the grains.

The silver halide emulsions for use in the present invention may contain various compounds or precursors, for the purpose of preventing the photographic material from being fogged during preparation, storage or photographic processing of the material and of stabilizing the photographic properties of the material. Specific examples of such compounds which are preferably used in the present invention are described in the above-mentioned JP-A 62-215272, pages 39 to 72. In addition, the 5-arylamino- 1,2,3,4-thiatriazole compounds (where the aryl residue has at least one electron-attracting group) described in EP 0447647 are also preferably used in the present invention.

The color sensitization is effected so as to make the emulsions of the layers constituting the photographic material of the present invention sensitive to light falling within a desired wavelength range.

For the color sensitization, used are color-sensitizing dyes effective in making photographic emulsions sensitive to blue, green and red ranges. Such are described in, for example, F. M. Harmer, Heterocyclic Compound—Cyanine Dyes and Related Compounds (John Wiley 7 Sons, New York, London, 1964). Specific examples of color-sensitizing compounds as well as color-sensitizing methods which are preferably employed in the present invention are described in, for example, the above-mentioned JP-A 62-215272, from page 22, right upper column to page 38. In particular, the color-sensitizing dyes described in JP-A 3-123340 are especially preferred as red-sensitizing dyes to be applied to silver halide grains having a high silver chloride content, in view of the high stability of the dyes themselves, the high intensity of adsorption of the dyes to silver halide grains, and the low temperature dependence of the dyes during exposure of photographic materials.

Where the photographic material of the present invention is desired to be made highly sensitive to infrared range, preferably are used the sensitizing dyes described in JP-A 3-15049, from page 12, left upper column to page 21, left lower column; JP-A 3-20730, from page 4, left lower column to page 15, left lower Column; EP 0420011, from page 4, line 21 to page 6, line 54; EP 0420012, from page 4, line 12 to page 10, line 33; and EP 0443466, U.S. Pat. No. 4,975,362.

To incorporate these color-sensitizing dyes into the silver halide emulsions of the present invention, for example, they may be directly dispersed thereinto, or alternatively, they are first dissolved in a single solvent such as water, methanol, ethanol, propanol, methyl cellosolve, 2,2,3,3-tetrafluoropropanol, etc. or a mixed solvent comprising them, and thereafter the resulting solution may be added to the emulsions. Apart from these cases, the dyes are formed into aqueous solutions in the presence of acids or bases in the manner such as that described in JP-B 44-23389, 44-27555, 57-22089, or are formed into aqueous solutions or colloidal dispersion in the presence of surfactants in the manner such as that described in U.S. Pat. Nos. 3,822,135, 4,006,025, and the resulting solutions or dispersions may be added to the emulsions. Also, they are first dissolved in solvents which are substantially immiscible with water, such as phenoxyethanol, etc. and then dispersed in water or hydrophilic colloids, and the resulting dispersions may be added to the emulsions. Also, they are directly dispersed into hydrophilic colloids in the manner such as that described in JP-A 53-102733, 58-105141, and the resulting dispersions may be added to the emulsions. The color-sensitizing dyes may be added to the emulsions at any time when the emulsions are prepared and which has heretofore been known acceptable. In other words, the time when the dyes are added to the emulsions may be any of before or during formation of the silver halide grains, immediately after formation of them and before rinsing them, before or during chemical sensitization of them, immediately after chemical sensitization of them and before cooling and solidifying them, and during preparation of coating compositions. More generally, the dyes are added to the emulsions after chemical sensitization of the emulsions and before coating them. If desired, however, the dyes may be added to the emulsions along with chemically-sensitizing dyes so as to effect the color sensitization and the chemical sensitization of the emulsions at the same time, in the manner such as that described in U.S. Pat. Nos. 3,628,969, 4,225,666; or the dyes may be added to the emulsions prior to the chemical sensitization of the emulsions or the color sensitization of the emulsions may be started before the completion of the formation of precipitates of silver halide grains in the manner such as that described in JP-A 58-113928. In addition, it is also possible to divide the color-sensitizing dye to be added into plural parts in the manner such as that taught by U.S. Pat. No. 4,225,666. According to the process, a part of the color-sensitizing dye is added to the emulsions prior to the chemical sensitization of them and the remaining part thereof is added thereto after the chemical sensitization. The addition of the color-sensitizing dyes to the photographic emulsions may be effected at any time when the silver halide grains are formed, for example, in accordance with the process taught by U.S. Pat. No. 4,183,756. Of the above-mentioned methods, especially preferred is the method where the dyes are added to the emulsions before the step of rinsing the emulsions or before the step of chemically sensitizing them.

The amount of the color-sensitizing dye to be added varies in a broad range, depending on the case of using it. Preferred is the range of from $0.5\times10^{-6}$ mol to $1.0\times10^{-2}$ mol, more preferably from $1.0\times10^{-6}$ mol to $5.0\times10^{-3}$ mol per mol of the silver halide.

When the photographic material of the present invention contains color-sensitizing dyes capable of making it sensitive to light falling within a red to infrared range, it is preferred to incorporate into the photographic material the compounds described in JP-A 2- 157749, from page 13, right lower column to page 22, right lower column, along with the dyes. Using these compounds, the storability of the photographic material, the stability during processing the material and the supercolor-sensitizing effect of the material may be specifically improved. Above all, the compounds of formulae (IV), (V) and (VI) described in said patent publication are especially preferred. The compound is added to the photographic material in an amount of from $0.5\times10^{-5}$ mol to $5.0\times10^{-2}$ mol, preferably from $5.0\times 10^{-5}$ mol to $5.0\times10^{-3}$ mol per mol of the silver halide in the material. The preferred range of the amount of the compound to be added is from 0.1 to 10000 molar times, preferably from 0.5 to molar 5000 times the sensitizing dye to be combined with the compound.

The photographic material of the present invention may be applied to a printing system using an ordinary negative printer. In addition to this, the material is also preferably applied to digital scanning exposure using monochromatic high-density lights such as gas lasers, light-emitting diodes, semiconductor lasers, secondary high-harmonics generating light sources (SHG) comprising a combination of a semiconductor laser or a solid laser where a semiconductor laser is used as an exciting light source and non-linear optical crystals, etc. In order to make the system compact and low-priced, use of semiconductor lasers or secondary high-harmonics generating light sources (SHG) comprising a combination of a semiconductor laser or solid laser and non-linear optical crystals is preferred. In particular, in order to design a low-priced, long-life and highly-safe device, use of semiconductor lasers is preferred, and it is desired to use a semiconductor laser as at least one light source for exposure.

When the above-mentioned light sources for scanning exposure are used, the maximum color sensitivity of the photographic material of the present invention may be freely defined, depending on the wavelength of the light source to be used for scanning exposure of the material. Using SHG light sources to be obtained by combining a solid laser where a semiconductor is used as the exciting light source or a semiconductor and non-linear optical crystals, the oscillating wavelength of the laser may be halved so that blue light and green light may be obtained. Therefore, the maximum color sensitivity of the photographic material to be exposed with such light sources may fall within ordinary ranges of three colors of blue, green and red. When semiconductor lasers are used as light sources so as to make the exposure device low-priced, highly-safe and compact, it is preferred that at least two layers constituting the photographic material to be exposed to them have a maximum color sensitivity at 670 nm or longer. This is because the wavelength range of the light to be emitted by low-priced and stable III-V Groups semiconductor lasers which are available at present is only from red to infrared range. In a laboratory level, however, oscillation of II-VI Groups semiconductor lasers in green to blue range has been confirmed. Therefore, it is surely expected that such semiconductor lasers may be used stably at low costs, after further development of the technique of producing such semiconductor lasers. If so, the necessity of making the photographic material have at least two photographic emulsion layers that have a maximum color sensitivity at 670 nm or longer will be unnecessary In such scanning exposure, the period of time for which the silver halides in the photographic material are exposed is the period of time for which a certain small area of the material is exposed. As the small area, generally used is the minimum unit for which the quantity of light is controlled from the corresponding digital data. The minimum unit is referred to as a pixel. Therefore, the exposure time per pixel shall be varied, depending on the size of pixel. The size of pixel depends on the pixel density, and its actual range is from 50 to 2000 dpi. Where the exposure time is defined to be a time so that a pixel size having a pixel density of 400 dpi is exposed, the preferred exposure time may be $10^{-4}$ second or less, more preferably $10^{-6}$ second or less.

The photographic material of the present invention preferably contains dyes which are decolored by photographic processing, such as those described in EP 0337490A2, pages 27 to 76, especially oxonole dyes or cyanine dyes, in its hydrophilic colloid layers, for the purpose of anti-irradiation and anti-halation and of improving the safety of the material against safelight.

Some of these water-soluble dyes often deteriorate the color separation of processed photographic materials or the safety thereof against safelight, if their amounts added are increased. As dyes which can be used without deteriorating the color separation of processed photographic materials, preferred are the water-soluble dyes described in JP-A-5-216185, 5-127325, 5-127324.

The photographic material of the present invention may have a colored layer, which may be decolored while the material is processed, in place of or along with the water-soluble dyes. The colored layer to be used, which may be decolored while the photographic material is processed, may be set in direct contact with the emulsion layers or may be disposed in the material in such a way that it is set in indirect contact with the emulsion layers via an interlayer containing gelatin or a color mixing preventing agent such as hydroquinone. It is preferred that the colored layer is disposed below the emulsion layer which colors to give a primary color of the same kind as the color of the colored layer, nearer to the support than the emulsion layer. It is possible either to dispose the corresponding colored layer to the primary color to be yielded by each emulsion layer or to dispose some of those freely selected from the emulsion layers. It is also possible to dispose a colored layer corresponding to plural emulsion layers yielding different colors. It is preferred that the optical reflective density of the colored layer falls from 0.2 to 3.0, more preferably from 0.5 to 2.5, especially preferably from 0.8 to 2.0, at the longest wavelength in the wavelength range of the light to be used for exposing the photographic material. (The wavelength range is the range of visible rays, which is from 400 nm to 700 nm, for ordinary printer exposure, while, for scanning exposure, it corresponds to the wavelength range of the light source to be used for scanning exposure.)

To provide the colored layer in the photographic material of the present invention, any known method may be employed. For instance, employable are a method of incorporating a dispersion of fine grains of a solid dye, such as those described in JP-A 2-282244, from page 3, right upper column to page 8 and those described in JP-A 3-7931, from page 3, right upper column to page 11, left lower column, into a hydrophilic colloid layer; a method of mordanting a cationic polymer with an anionic dye; a method of making a dye adsorb to fine grains of silver halides, etc. to thereby fix the dye in the colored layer; and a method of using a colloidal silver such as that described in JP-A 1-239544. As the method of dispersing fine grains of a solid dye into a hydrophilic colloid layer, for example, JP-A 2-308244 has disclosed, on pages 4 to 13, a method of incorporating fine grains of a dye which is substantially insoluble in water at least in a condition at pH 6 or lower but is substantially soluble in water at least in a condition at pH 8 or higher, into a colloid layer. One example of the method of mordanting a cationic polymer with an anionic dye has been described in JP-A 2-84637, pages 18 to 26. Methods for preparing colloidal silvers, which act as a light-absorbing agent, are disclosed in U.S. Pat. Nos. 2,688,601 and 3,459,563. Of these methods, preferred are the method of incorporating fine dye grains and the method of using a colloidal silver.

As the binder or protective colloid which may be used in the photographic material of the present invention, gelatin is preferred but any other hydrophilic colloid may also be used singly or along with gelatin. As the gelatin, preferred is a low-calcium gelatin having a calcium content of 800 ppm or less, more preferably 200 ppm or less. In order to prevent the growth of various fungi or bacteria, which grow in hydrophilic colloid layers to deteriorate the image quality of the images to be formed, it is preferred to add an anti-microbial agent such as that described in JP-A 63-271247 to the hydrophilic colloid layers constituting the photographic material of the present invention.

Where the photographic material of the present invention is subjected to printer exposure, it is preferred to use a band-stop filter such as that described in U.S. Pat. No. 4,880,726. Using this, color mixing may be inhibited so that the color reproducibility of the photographic material is noticeably improved.

The exposed photographic material of the present invention is processed according to conventional color development. To rapidly process it, the material is, after having been subjected to color development, preferably blixed. In particular, when the material contains the above-mentioned high-silver chloride emulsions, the pH value of the blixer to be used is preferably about 6.5 or less, more preferably about 6 or less, so as to promote the desilvering of the material.

As silver halide emulsions and other elements (e.g., additives, etc.) of constituting the photographic material of the present invention, photographic layers of constituting the material (e.g., arrangement of layers), and methods of processing the material and additives usable in the processing methods, those described in the following patent publications, especially in European Patent 0,355,660A2 (corresponding to JP-A 2-139544), are preferably employed.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 up to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 up to page 18, left lower column, last line | — | — |
| Chemical Sensitizers | Page 12, from left lower column, line 3 up to right lower column, line 5 up; and from page 18, right lower column, line 1 to page 22, right upper column, line 9 up | Page 29, right lower column, line 12 to last line | Page 47, lines 4 to 9 |

-continued

| Photographic Elements | JP-A 62-215272 | JP-A 2-33144 | EP 0,355,660A2 |
|---|---|---|---|
| Color Sensitizers (Color Sensitizing Methods) | From page 22, right upper column, line 8 up to page 38, last line | Page 30, left upper column, lines 1 to 13 | Page 47, lines 10 to 15 |
| Emulsion Stabilizers | From page 39, left upper column, line 1 to page 72, right upper column, last line | Page 30, left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 up | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Developer Inhibitor Releasing Compounds | Page 155, right lower column, lines 3 to 9 | — | — |
| Supports | From page 155, right bottom column, line 19 to page 156, left to column, line 14 | From page 38, right top column, line 18 to page 39, left top column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 up to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper | — | — |

-continued

| Photographic Elements | JP-A 62-215272 | JP-A 2-33144 | EP 0,355,660A2 |
|---|---|---|---|
| | column, line 1 to page 227, right upper column, line 2 | | |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The cited specification of JP-A 62-215272 is one as amended by the letter of amendment filed on March 16, 1987.
In addition to the above-mentioned couplers, so-called shortwave-type yellow couplers such as those described in JP-A 63-231451, 63-123047, 63-241547, 1-173499, 1-213648 and 1-250944 are also preferably used.

It is preferred that cyan, magenta or yellow couplers are infiltrated into loadable latex polymers (for example, those described in U.S. Pat. No. 4,203,716) in the presence of high boiling point organic solvents such as those referred to in the above-mentioned table or are dissolved in such solvents along with water-insoluble and organic solvent-soluble polymers and are emulsified and dispersed in aqueous solutions of hydrophilic colloids.

As preferred water-insoluble and organic solvent-soluble polymers, for example, mentioned are homopolymers or copolymers described in U.S. Pat. No. 4,857,449, columns 7 to 15 and International Patent Laid-Open No. WO88/00723, pages 12 to 30. In particular, methacrylate or acrylamide polymers, especially acrylamide polymers are preferably used in view of the high stability of color images to be formed.

It is preferred that the photographic material of the present invention contains color image stability improving compounds such as those described in EP 0,277,589A2 along with couplers. In particular, such compounds are preferably combined with pyrazoloazole couplers, pyrrolotriazole couplers and acylacetamide yellow couplers.

Specifically, it is preferred to add to the photographic material of the present invention compounds capable of chemically bonding to the aromatic amine developing agent remaining in the material after its color development to form therein substantially colorless compounds which are chemically inactive, such as those described in the above-mentioned EP specification and/or compounds capable of chemically bonding to the oxidation product of an aromatic amine developing agent remaining in the material after its color development to form therein substantially colorless compounds which are chemically inactive, such as those described in the above-mentioned EP specification, singly or as combined, since the compounds added to the material can prevent the color developing agent or its oxidation product remaining in the processed material from reacting with the couplers in the material to form stains or can prevent other harmful side effects while the processed material is stored.

As cyan couplers for use in the present invention, preferred are diphenylimidazole cyan couplers such as those described in JP-A 2-33144 as well as 3-hydroxypyridine cyan couplers such as those described in EP 0333185A2 (especially preferably, one of 4-equivalent couplers illustrated therein, Coupler (42), into which splitting-off chloride groups have been introduced so as to make it 2-equivalent, and Couplers (6) and (9)), active acyclic methylene cyan couplers such as those described in JP-A 64-32260 (especially preferably, Couplers 3, 8 and 34 illustrated therein), pyrrolopyrazole cyan couplers such as those described in EP 0456226A1, pyrroloimidazole cyan couplers such as those described in EP 0484909, and pyrrolotriazole cyan couplers such as those described in EP 0488248 and EP 0491197A1. Of these, especially preferred are pyrrolotriazote cyan couplers.

As magenta couplers which may be used in the present invention, for example, mentioned are 5-pyrazolone magenta couplers such as those described in the references referred to in the above-mentioned table. As 5-pyrazolone magenta couplers, preferred are those described in International Patent Laid-Open Nos. WO92/18901, WO92/18902 and WO92/18903, from which an arylthio group splits off, since the storage stability of color images formed is good and the quality of color images formed fluctuates little during processing of photographic materials.

As magenta couplers which may be used in the present invention, known pyrazoloazole couplers may also be used. In particular, preferred for use in the present invention are pyrazolotriazole couplers in which a secondary or tertiary alkyl group is directly bonded to the 2-, 3- or 6-position of the pyrazolotriazole ring, such as those described in JP-A 61-65245; pyrazoloazole couplers having sulfonamido group(s) in the molecule, such as those described in JP-A 61-65246; pyrazoloazole couplers having alkoxyphenylsulfonamido ballast group(s) in the molecule, such as those described in JP-A 61- 147254; and pyrazoloazole couplers having an alkoxy or aryloxy group at the 6-position in the molecule, such as those described in EP 226,849A and EP 294785A, since such couplers have good coloring properties and form good images having favorable color hue and high image stability.

As yellow couplers, known acylacetanilide couplers are preferably used in the present invention. In particular, especially preferred are pivaloylacetanilide couplers having a halogen atom or an alkoxy group at the ortho-position of the anilido ring; acylacetanilide couplers in which the acyl group is a cycloalkanecarbonyl group bonding to the molecule at its 1-position, such as those described in EP 0447969A, JP-A 5-107701, 5-113642; and malondianilide couplers such as those described in EP 0524540A.

To process the color photographic material of the present invention, the methods referred to in the above-mentioned table can be employed. In addition to these, the processing materials and the processing methods described in JP-A 2-207250, from page 26, right lower column, line 1 to page 34, right upper column, line 9 and in JP-A 4-97355, from page 5, left upper column, line 17 to page 18, right lower column, line 20 are preferably employed.

The present invention is described in more detail by means of the following examples, which, however, are not intended to restrict the scope of the present invention.

EXAMPLE 1

150 g of a polymer of the present invention, P- 12, having a number average molecular weight of 600, 1100 g of an ultraviolet absorbent, UV-1, and 300 ml of ethyl acetate were dissolved under heat at 60° C., and the resulting solution was emulsified and dispersed in 5000 g of an aqueous solution of 20 wt.% of gelatin containing 100 g of a surfactant, W-l, using a rapid-stirring emulsifier. After thus emulsified, water was added to the resulting emulsion and well blended to make 12000 g as a whole. Thus, Emulsion A was obtained.

Ultraviolet Absorbent, UV-1:

1/1/2/3/2 (by weight) mixture of the following (1), (2), (3), (4)and (5):

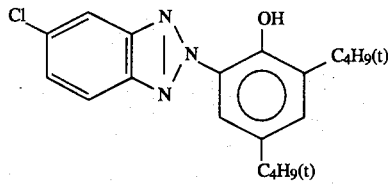

(1)

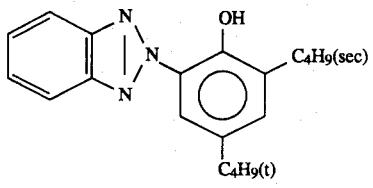

(2)

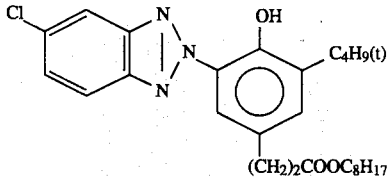

(3)

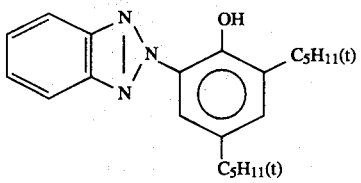

(4)

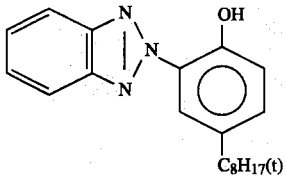

(5)

Surfactant, W-1:

3/1/1 (by weight) mixture of the following (1), (2) and (3):

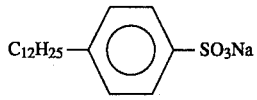

(1)

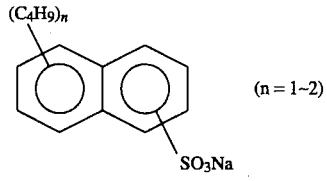

(2)

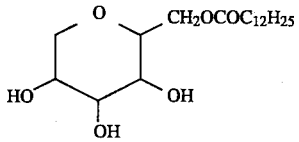

(3)

To assess it, the emulsion was subjected to the following tests 1 and 2:

Test 1: Measurement of Grain Size

Immediately after emulsification, the mean grain size of the emulsion was measured, using Coal Tar Submicron Grain Analyzer Model N4 (produced by Coal Tar Electronics Co.). For emulsions prepared under the same conditions, in general, the smaller grain size, the better. This is because emulsions having a smaller grain size can be emulsified more easily.

Test 2: Measurement of the Numbers of Coarse Grains in Fresh Emulsion and Emulsion Stored in Refrigerator 200 g of an aqueous solution of 10% gelatin were added to 50 g of the emulsion (either fresh emulsion or emulsion stored in a refrigerator), blended under heat at 40° C., and 5.0 ml of the resulting blend was coated on a glass plate of 100 $cm^2$. After this was spontaneously dried in air, the number of coarse grains with a diameter of not smaller than 20 μm existing in the unit area of 1 $cm^2$ of the coated film on the glass plate was counted, using an optical microscope. The smaller the number of the coarse grains, the better. If the number of the coarse grains is more than 1.0/$cm^2$, such is problematic in that the coarse grains often cause surface troubles when the emulsion is actually coated on a photographic support.

Emulsions B to T were prepared in the same manner as in preparation of Emulsion A, except that the polymer and the high boiling point organic solvent were varied to those indicated in Table 1 below. The polymer, the ultraviolet absorbent and the high boiling point organic solvent were co-emulsified. These emulsions were assessed by Test 1 and Test 2. The results are shown in Table 1.

TABLE 1

| High Boiling | Number of Coarse Grains (/$cm^2$) |
|---|---|

| Emulsion | Polymer (amount) | Point Organic Solvent (amount) | Grain Size (μ) | Fresh Emulsion | Emulsion Stored at 5° C. for 14 hours | Sample No. | Light Fastness ($D/D_0$ %) | Remarks |
|---|---|---|---|---|---|---|---|---|
| A | P-12 (mean molecular weight 600) (150 g) | — | 0.098 | 0.2 | 0.6 | 101 | 86 | sample of the invention |
| B | P-12 (mean molecular weight 1900) (150 g) | — | 0.105 | 0.3 | 0.9 | 102 | 86 | sample of the invention |
| C | P-12 (mean molecular weight 3000) (150 g) | — | 0.140 | 0.9 | 4.8 | 103 | 87 | comparative sample |
| D | P-12 (mean molecular weight 600) (150 g) | S-13 (150 g) | 0.094 | 0.2 | 0.3 | 104 | 86 | sample of the invention |
| E | — | — | 0.120 | 1.0 | 30.3 | 105 | 55 | comparative sample |
| F | — | S-13 (150 g) | 0.110 | 0.2 | 5.6 | 106 | 51 | comparative sample |
| G | Comparative Polymer(*1) (mean molecular weight 600) (150 g) | — | 0.110 | 0.5 | 5.6 | 107 | 61 | comparative sample |
| H | Comparative Polymer(*1) (mean molecular weight 1900) (150 g) | — | 0.115 | 0.9 | 6.0 | 108 | 63 | comparative sample |
| I | Comparative Polymer(*1) (mean molecular weight 3000) (150 g) | — | 0.145 | 1.2 | 10.3 | 109 | 64 | comparative sample |
| J | Comparative Polymer(*2) (mean molecular weight 600) (150 g) | — | 0.112 | 0.6 | 6.0 | 110 | 59 | comparative sample |
| K | Comparative Polymer(*3) (mean molecular weight 600) (150 g) | — | 0.112 | 0.5 | 6.2 | 111 | 57 | comparative sample |
| L | P-1 (mean molecular weight 600) (150 g) | — | 0.102 | 0.4 | 0.7 | 112 | 82 | sample of the invention |
| M | P-13 (mean molecular weight 600) (150 g) | — | 0.098 | 0.2 | 0.6 | 113 | 85 | sample of the invention |
| N | P-17 (mean molecular weight 600) (150 g) | — | 0.098 | 0.2 | 0.6 | 114 | 85 | sample of the invention |
| O | P-33 (mean molecular weight 600) (150 g) | — | 0.105 | 0.4 | 0.9 | 115 | 82 | sample of the invention |
| P | P-12 (mean molecular weight 600) (150 g) | S-2 (150 g) | 0.094 | 0.2 | 0.4 | 116 | 86 | sample of the invention |
| Q | P-12 (mean molecular weight 600) (150 g) | S-32 (150 g) | 0.096 | 0.2 | 0.5 | 117 | 86 | sample of the invention |
| R | P-12 (mean molecular weight 600) | S-30 (150 g) | 0.098 | 0.2 | 0.6 | 118 | 85 | sample of the invention |

| | | | | | | | | |
|---|---|---|---|---|---|---|---|---|
| | (150 g) | | | | | | | |
| S | P-1 (mean molecular weight 600) (300 g) | S-4 (150 g) | 0.096 | 0.3 | 0.6 | 119 | 85 | sample of the invention |
| T | P-33 (mean molecular weight 1000) (150 g) | S-13 (250 g) | 0.094 | 0.3 | 0.6 | 120 | 85 | sample of the invention |

(*1)Comparative Polymer 1:
$-(CH_2-CH_3COOCH_{3CH})_n-$
(*2)Comparative Polymer 2:
$-(CH_2-CONHC_6H_{13}(n)CH)_n-$
(*3)Comparative Polymer 3:
$-(CH_2-OOCCH_{3CH})_n-$ From Table 1 above, it is known that the grain size of the grains in the emulsions each containing the polymer of the present invention was smaller than that in the emulsions each containing the polymer not falling within the scope of the present invention and that the number of the coarse grains existing in the former emulsions was smaller than that in the latter emulsions. It is also known therefrom that the increase in the number of the coarse grains in the emulsions stored in a refrigerator was suppressed by the combined use of the polymer of the present invention and the high boiling point organic solvent in preparing the emulsions.

To assess the photographic properties of these emulsions, multi-layered color printing papers each having the constitution mentioned below were prepared.

Precisely, the surface of a paper support that had been duplex-laminated with polyethylene was treated by corona discharging, and this was coated with a subbing gelatin layer containing sodium dodecylbenzenesulfonate and then with various photographic constitutive layers mentioned below. Thus, a multi-layered color printing paper, No. 101, having the layer constitution mentioned below was prepared.

As the gelatin hardening layer in each layer, used was sodium 1-hydroxy-3,5-dichloro-s-triazine.

To each layer, added were 25.0 mg/m$^2$ of Cpd-14 and 50.0 mg/m$^2$ of Compound 15.

The following color-sensitizing dyes were added to the silver chlorobromide emulsions in the light-sensitive emulsion layers.

Blue-sensitive Emulsion Layer:

Sensitizing Dye A:

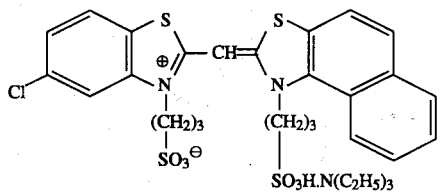

and

Sensitizing Dye B:

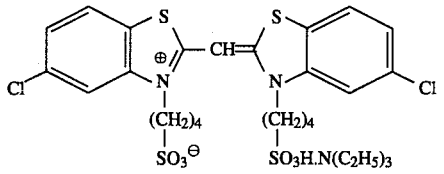

and

Sensitizing Dye C:

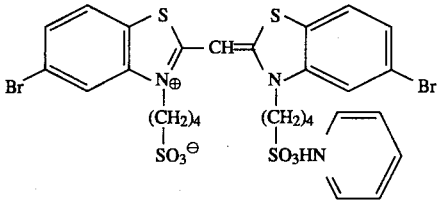

(These were added each in an amount of $1.4\times10^{-4}$ mol per mol of silver halide to the large-size emulsion and $1.7\times10^{-4}$ mol per mol of silver halide to the small-size emulsion.)

Green-sensitive Emulsion Layer:

Sensitizing Dye D:

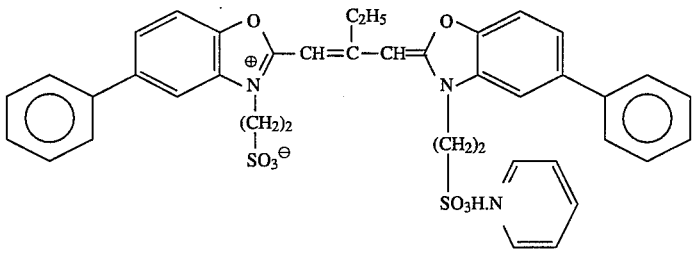

(This was added in an amount of $3.0\times10^{-4}$ mol per mol of silver halide to the large-size emulsion and $3.6\times10^{-4}$ mol per mol of silver halide to the small-size emulsion.)

Sensitizing Dye E:

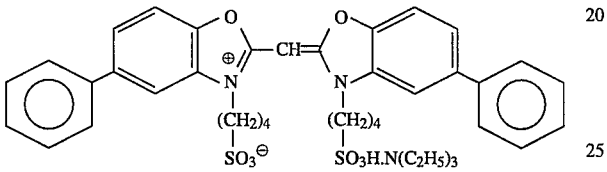

(This was added in an amount of $4.0\times10^{-5}$ mol per mol of silver halide to the large-size emulsion and $7.0\times10^{-5}$ mol per mol of silver halide to the small-size emulsion.)

Sensitizing Dye F:

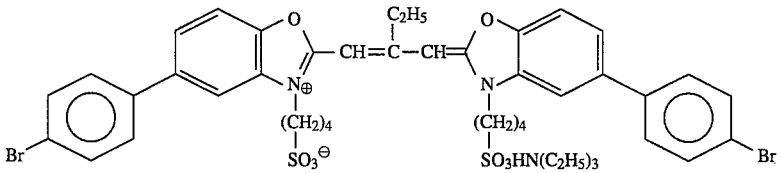

(This was added in an amount of $2.0\times10^{-4}$ mol per mol of silver halide to the large-size emulsion and $2.8\times10^{-4}$ mol per mol of silver halide to the small-size emulsion.)

Red-sensitive Emulsion Layer:

Sensitizing Dye G:

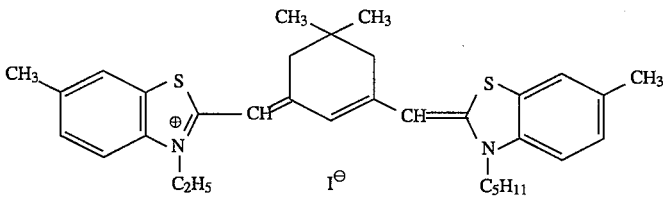

(This was added in an amount of $1.0\times10^{-4}$ mol per mol of silver halide to the large-size emulsion and $1.2\times10^{-4}$ mol per mol of silver halide to the small-size emulsion.)

Sensitizing Dye H:

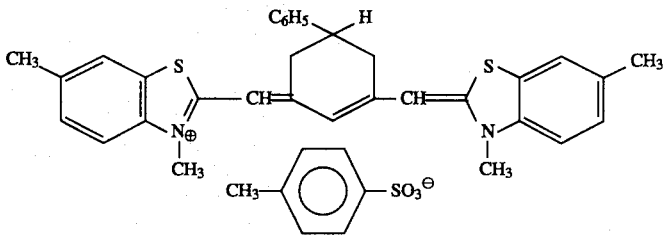

(This was added in an amount of $5.0\times10^{-5}$ mol per mol of silver halide to the large-size emulsion and $6.0\times10^{-5}$ mol per mol of silver halide to the small-size emulsion.)

To the red-sensitive emulsion layer was added the following compound in an amount of $2.6\times10^{-3}$ mol per mol of silver halide.

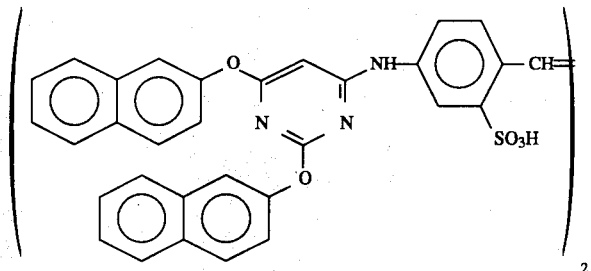

To each of the blue-sensitive emulsion layer, the green-sensitive emulsion layer and the red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, each per mol of silver halide, respectively.

To each of the blue-sensitive emulsion layer and the green-sensitive emulsion layer was added 4-hydroxy-6-methyl- 1,3,3a,7-tetrazaindene in an amount of $1\times10^{-4}$ mol and $2\times10^{-4}$ mol, each per mol of silver halide, respectively.

| Layer Constitution of Photographic Material Sample: | |
|---|---|
| The composition of each layer of the photographic material sample is mentioned below. The number indicates the amount of the component coated (g/m²). The amount of the silver halide emulsion coated is represented by the amount of silver therein coated. | |
| Support: | |
| Polyethylene-laminated Paper (containing white pigment ($TiO_2$) and bluish dye (ultramarine) in polyethylene below the first layer) | |
| First Layer (Blue-sensitive Emulsion Layer): | |
| Silver Chlorobromide Emulsion (⅔ (as silver molar ratio) mixture comprising a large-size emulsion A of cubic grains with a mean grain size of 0.88 μm and a small-size emulsion A of cubic grains with a mean grain size of 0.70 μm; the two emulsions each having a fluctuation coefficient of grain size distribution of 0.08 and 0.10, respectively, and each having 0.30 mol % of AgBr locally on the surfaces of the base grains composed of silver chloride) | 0.30 |

-continued

| | |
|---|---|
| Gelatin | 1.46 |
| Yellow Coupler (ExY) | 0.68 |
| Color Image Stabilizer (Cpd-1) | 0.10 |
| Color Image Stabilizer (Cpd-2) | 0.05 |
| Color Image Stabilizer (Cpd-3) | 0.12 |
| Solvent (Solv-1) | 0.20 |
| Solvent (Solv-5) | 0.05 |
| Second Layer (Color Mixing Preventing Layer): | |
| Gelatin | 1.10 |
| Color Mixing Preventing Agent (Cpd-4) | 0.10 |
| Additive (Cpd-9) | 0.05 |
| Solvent (Solv-2) | 0.15 |
| Solvent (Solv-3) | 0.30 |
| Solvent (Solv-1) | 0.05 |
| Third Layer (Green-sensitive Emulsion Layer): | |
| Silver Chlorobromide Emulsion (⅓ (as silver molar ratio) mixture comprising a large-size emulsion B of cubic grains with a mean grain size of 0.55 μm and a small-size emulsion B of cubic grains with a mean grain size of 0.39 μm; the two emulsions each having a fluctuation coefficient of grain size distribution of 0.10 and 0.08, respectively, and each having 0.8 mol % of AgBr locally on the surfaces of the base grains composed of silver chloride) | 0.13 |
| Gelatin | 1.45 |
| Magenta Coupler (ExM) | 0.18 |
| Color image Stabilizer (Cpd-5) | 0.02 |
| Color Image Stabilizer (Cpd-2) | 0.01 |
| Color Image Stabilizer (Cpd-6) | 0.01 |
| Color image Stabilizer (Cpd-7) | 0.01 |
| Color Image Stabilizer (Cpd-8) | 0.08 |
| Ultraviolet Absorbent (UV-2) | 0.15 |
| Solvent (Solv-8) | 0.56 |
| Solvent (Solv-7) | 0.24 |
| Color Image Stabilizer (Cpd-12) | 0.10 |
| Fourth Layer (Color Mixing Preventing Layer): | |
| Gelatin | 0.88 |
| Color Mixing Preventing Agent (Cpd-4) | |
| Additive (Cpd-9) | 0.04 |
| Solvent (Solv-2) | 0.12 |
| Solvent (Solv-3) | 0.24 |
| Solvent (Solv-1) | 0.04 |
| Fifth Layer (Red-sensitive Emulsion Layer): | |
| Silver Chlorobromide Emulsion (¼ (as silver molar ratio) mixture comprising a large-size emulsion C of cubic grains with a mean grain size of 0.50 μm and a small-size emulsion C of cubic grains with a mean grain size of 0.41 μm; the two emulsions each having a fluctuation coefficient of grain size distribution of 0.09 and 0.11, respectively, and each having 0.8 mol % of AgBr locally on the surfaces of the base grains composed of silver chloride) | 0.20 |
| Gelatin | 0.85 |
| Cyan Coupler (ExC) | 0.31 |
| Ultraviolet Absorbent (UV-2) | 0.18 |
| Color Image Stabilizer (Cpd-9) | 0.01 |
| Additive (Cpd-10) | 0.01 |

-continued

| | |
|---|---|
| Additive (Cpd-11) | 0.01 |
| Solvent (Solv-6) | 0.25 |
| Color Image Stabilizer (Cpd-8) | 0.01 |
| Color Image Stabilizer (Cpd-6) | 0.01 |
| Solvent (Solv-1) | 0.01 |
| Color Image Stabilizer (Cpd-1) | 0.31 |
| Sixth Layer (Ultraviolet Absorbing Layer): | |
| Gelatin | 0.60 |
| Ultraviolet Absorbent (UV-1) | 0.44 |
| Polymer (P-12) | 0.06 |

-continued

| | |
|---|---|
| Seventh Layer (Protective Layer): | |
| Gelatin | 1.13 |
| Acryl-modified Copolymer of Polyvinyl Alcohol (modification degree 17%) | 0.05 |
| Liquid Paraffin | 0.02 |
| Color Image Stabilizer (Cpd-13) | 0.01 |

The compounds used above are mentioned below.

(ExY) Yellow Coupler:

1/1 (by mol) mixture of the following:

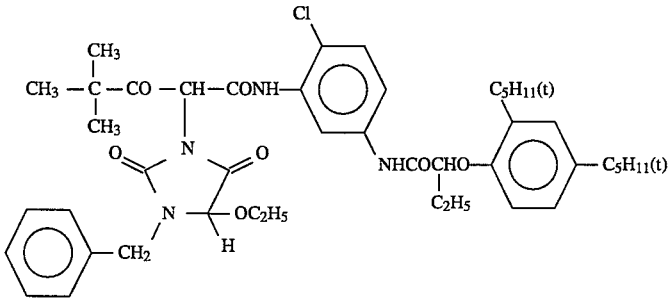

and

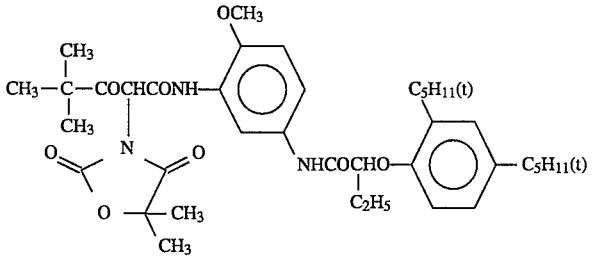

(ExM) Magenta Coupler:

1/1 (by mol) mixture of the following:

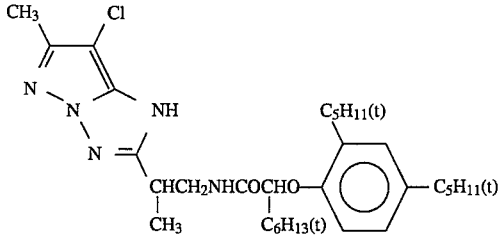

and

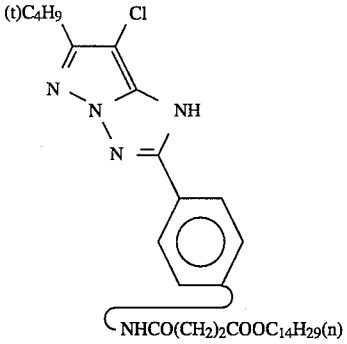

(ExC) Cyan Coupler:

25/75 (by mol) mixture of the following:

-continued
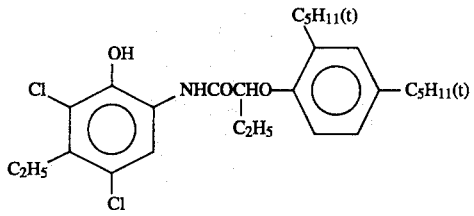
and
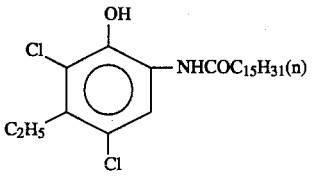
(Cpd-1) Color Image Stabilizer:
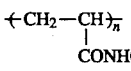
mean molecular weight: 60,000
(Cpd-2) Color Image Stabilizer:
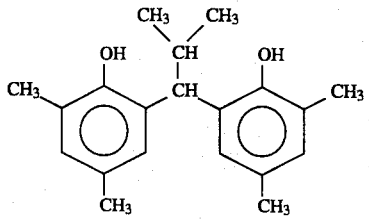
(Cpd-3) Color Image Stabilizer:
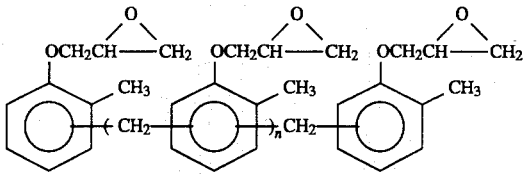
n = 7 to 8 (as mean value)
(Cpd-4) Color Image Stabilizer:
1/1 (by mol) mixture of the following:
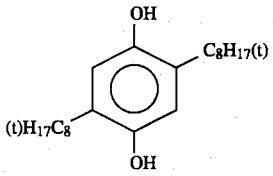
(HQ-1)
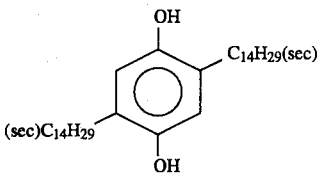
(HQ-2)
(Cpd-5) Color Image Stabilizer:
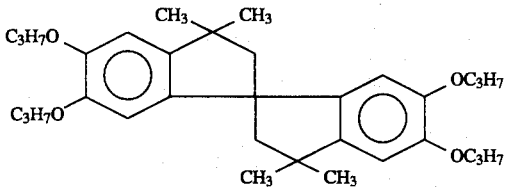
(Cpd-6) Color Image Stabilizer:

-continued
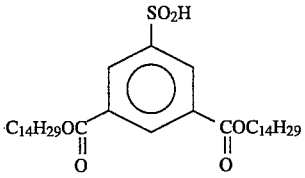
(Cpd-7) Color Image Stabilizer:
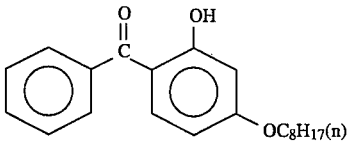
(Cpd-8) Color Image Stabilizer:
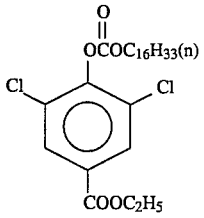
(Cpd-9) Additive:
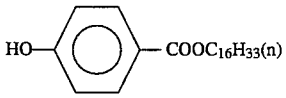
(Cpd-10) Color Image Stabilizer:
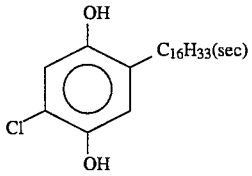
(Cpd-11) Color Image Stabilizer:
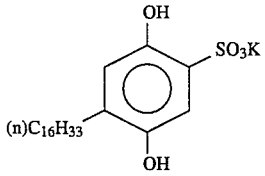
(UV-1) Ultraviolet Absorbent:
1/2/2/3/2 mixture (by weight) of the following:
(1)
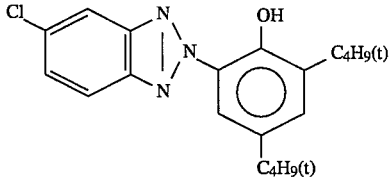
(2)
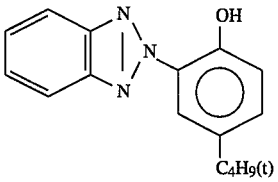

-continued
(3)
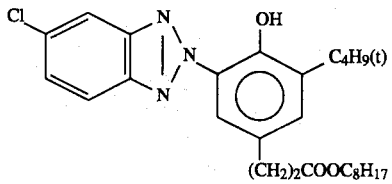
(4)
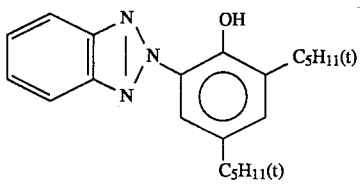
(5)
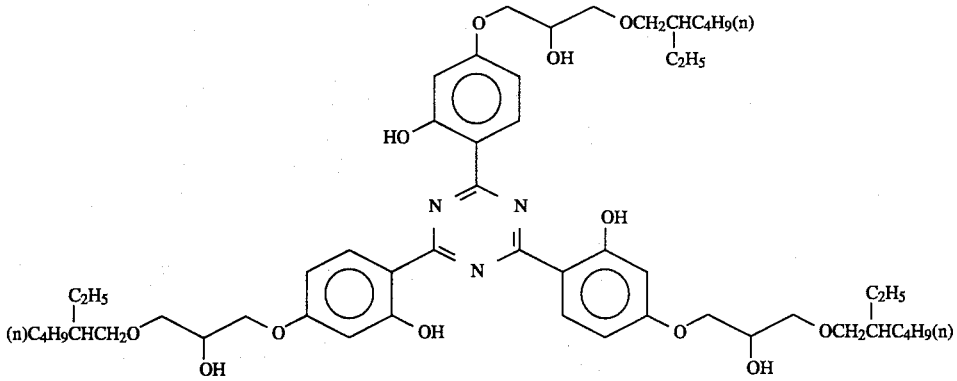
(UV-2) Ultraviolet Absorbent:
1/1/2/2 mixture (by weight) of the following:
(1)
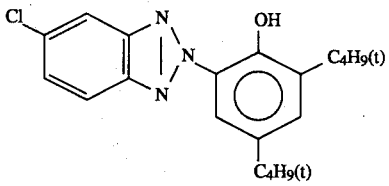
(2)
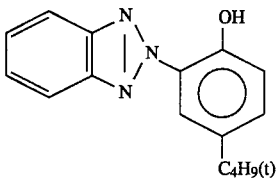
(3)
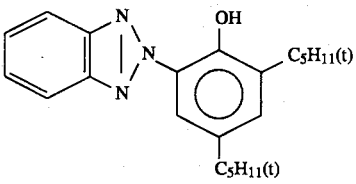
(4)
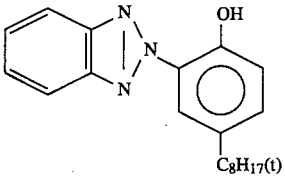
(Cpd-12) Color Image Stabilizer:
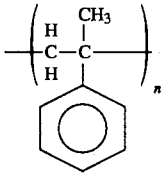
n = 5 to 10 (as mean value)
(Cpd-13) Color Image Stabilizer:

-continued
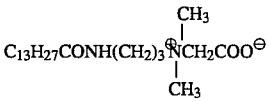
(Cpd-14) Antiseptic:
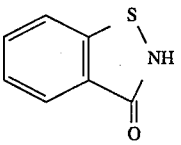
(Cpd-15) Antiseptic:
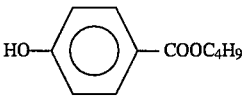
(Solv-1) Solvent:
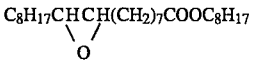
(Solv-2) Solvent:
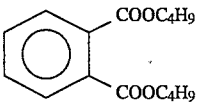
(Solv-3) Solvent:
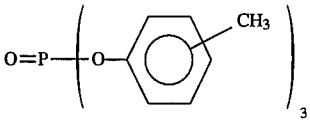
(Solv-5) Solvent:
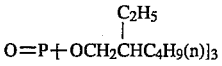
(Solv-6) Solvent:
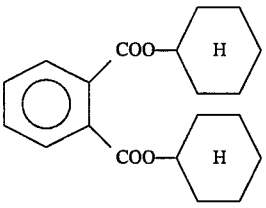
(Solv-7) Solvent:
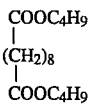
(Solv-8) Solvent:

$O=P-[OC_6H_{13}(n)]_3$

Samples Nos. 102 to 120 were prepared in the same manner as in preparation of Sample No. 101, except that the emulsion for the sixth layer was replaced by that shown in Table 2 below. The amount of the ultraviolet absorbent in the sixth layer coated was the same in sample No. 101.

Sample No. 101 was exposed, using a sensitometer (FWH Model having a color temperature of 3200° K. at the light source, produced by Fuji Photo Film Co.), in such a way that about 35% of the silver coated might be developed to give a gray color.

200 $m^2$ of the thus-exposed sample was continuously processed, using a paper processor, according to the process mentioned below. The .processing solutions used herein are mentioned below.

Processing Steps:

| Step | Temp. | Time | Replenisher (ml)(*) | Tank Capacity (liter) |
|---|---|---|---|---|
| Color Development | 35° C. | 45 sec | 161 | 10 |
| Bleach-Fixation | 35° C. | 45 sec | 218 | 10 |
| Rinsing (1) | 35° C. | 30 sec | — | 5 |
| Rinsing (2) | 35° C. | 30 sec | — | 5 |
| Rinsing (3) | 35° C. | 30 sec | 360 | 5 |
| Drying | 80° C. | 60 sec | | |

Rinsing was effected by a three-tank countercurrent cascade system from the rinsing tank (3) to the rinsing tank (1).

The processing solutions used in the above-mentioned process are mentioned below.

| | Tank Solution | Replenisher |
|---|---|---|
| Color Developer: | | |
| Water | 800 ml | 800 ml |
| Ethylenediamine-tetraacetic Acid | 3.0 g | 3.0 g |
| Disodium 4,5-Dihydroxybenzene-1,3-disulfonate | 0.5 g | 0.5 g |
| Triethanolamine | 12.0 g | 12.0 g |
| Potassium Chloride | 2.5 g | — |
| Potassium Bromide | 0.01 g | — |
| Potassium Carbonate | 27.0 g | 27.0 g |
| Brightening Agent (WHITEX 4B, product by Sumitomo Chemical Co.) | 1.0 g | 2.5 g |
| Sodium Sulfite | 0.1 g | 0.2 g |
| Disodium-N,N-bis(sulfonatoethyl) hydroxylamine | 5.0 g | 8.0 g |
| N-ethyl-N-(β-methanesulfonamido-ethyl)-3-methyl-4-animoaniline 3/2 Sulfate Monohydrate | 5.0 g | 7.1 g |
| Water to make | 1000 ml | 1000 ml |
| pH (adjusted with potassium hydroxide and sulfuric acid, 25° C.) | 10.05 | 10.45 |
| Bleach-fixing Solution: | | |
| Both the tank solution and the replenisher were the same. | | |
| Water | | 600 ml |
| Ammonium Thiosulfate (700 g/liter) | | 100 ml |
| Ammonium Sulfite | | 40 g |

-continued

| | |
|---|---|
| Ammonium Ethylenediaminetetraacetato/iron(III) | 55 g |
| Iron Ethylenediaminetetraacetate | 5 g |
| Ammonium Bromide | 40 g |
| Sulfuric Acid (67%) | 30 g |
| Water to make | 1000 ml |
| pH (adjusted with acetic acid and aqueous ammonia, 25° C.) | 5.8 |
| Rinsing Solution: | |
| Both the tank solution and the replenisher were the same. | |
| Sodium Chloroisocyanurate | 0.02 g |
| Deionized Water (having an electroconductivity of 5 μs/cm or less) | 1000 ml |
| pH | 6.5 |

(*) This is an amount of the replenisher per $m^2$ of the color paper sample being processed.

Next, Samples Nos. 101 to 120 each were subjected to gradation exposure, using blue, green and red filters, so that they might be developed in gray, and the exposed samples were then processed with the above-mentioned processing solutions. The thus-processed samples were exposed to xenon light of 100,000 luxes for 5 weeks at a relative humidity of 55%, using a xenon fading tester. The magenta density of each of the thus-faded samples was measured at the point that had had a magenta density of 0.5 before the fading test. The relative retentiveness of the color density was calculated from the measured data, from which the light fastness of each sample was assessed. The results are shown in Table 1 above.

From Table 1, it is known that the polymer of the present invention has an effect of improving the light fastness of the color formed. In particular, it is known therefrom that the polymers having aromatic groups have a much higher fastness-improving effect than those not having aromatic groups.

In view of the stability of the emulsions and the light fastness of the color papers that were clarified by the test results, it is understood that the polymers having aromatic groups and having a low molecular weight of the present invention are synthetically good.

EXAMPLE 2

Other emulsions were prepared in the same manner as in preparation of Emulsions A to K in Table 1 above, except that the ultraviolet absorbent was changed to UV-3 and that the amount of ethyl acetate, which was the auxiliary solvent in preparing the emulsions, was increased by 1.5 or 2.0 times. The number of the coarse grains in each of these emulsions was counted by the same method of Test 2.

The results obtained are shown in Table 2 below.

Ultraviolet Absorbent (UV-3):

1/1/2/1 (by weight ) mixture of the following:

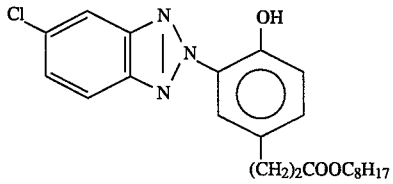

(1)

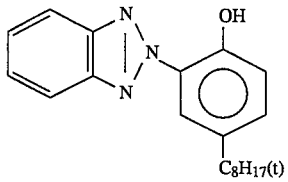

(2)

-continued

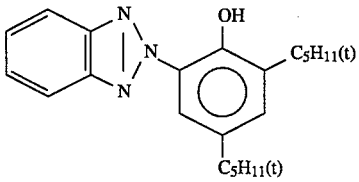

(3)

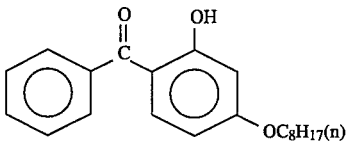

(4)

TABLE 2

| Emulsion (amount) | Polymer | High Boiling Point Organic Solvent | Auxiliary Solvent (amount, ml) | Number of Coarse Grains (/cm$^2$) Fresh Emulsion | Emulsion Stored at 5° C. for 14 days | Remarks |
|---|---|---|---|---|---|---|
| a | P-12 (mean molecular weight, 600) | — | 300 | 0.2 | 0.6 | sample of the invention |
| a (1.5 times) | P-12 (mean molecular weight, 600) | — | 450 | 0.1 | 0.4 | sample of the invention |
| a (2.0 times) | P-12 (mean molecular weight, 600) | — | 600 | 0.1 | 0.2 | sample of the invention |
| b | P-12 (mean molecular weight, 1900) | — | 300 | 0.3 | 0.9 | sample of the invention |
| b (1.5 times) | P-12 (mean molecular weight, 1900) | — | 450 | 0.2 | 0.5 | sample of the invention |
| b (2.0 times) | P-12 (mean molecular weight, 1900) | — | 600 | 0.1 | 0.3 | sample of the invention |
| c | P-12 (mean molecular weight, 3000) | — | 300 | 0.9 | 4.8 | comparative sample |
| c (1.5 times) | P-12 (mean molecular weight, 3000) | — | 450 | 0.7 | 3.0 | comparative sample |
| c (2.0 times) | P-12 (mean molecular weight, 3000) | — | 600 | 0.5 | 1.5 | comparative sample |
| d | P-12 (mean molecular weight, 600) | S-13 | 300 | 0.2 | 0.3 | sample of the invention |
| d (1.5 times) | P-12 (mean molecular weight, 600) | S-13 | 450 | 0.1 | 0.2 | sample of the invention |
| d (2.0 times) | P-12 (mean molecular weight, 600) | S-13 | 600 | 0.1 | 0.1 | sample of the invention |
| e | — | — | 300 | 1.0 | 30.3 | comparative sample |
| e (1.5 times) | — | — | 450 | 0.9 | 18.0 | comparative sample |
| e (2.0 times) | — | — | 600 | 0.9 | 6.2 | comparative sample |
| f | — | S-13 | 300 | 0.2 | 5.6 | comparative sample |
| f (1.5 times) | — | S-13 | 450 | 0.2 | 2.9 | comparative sample |
| f (2.0 times) | — | S-13 | 600 | 0.1 | 0.9 | comparative sample |
| g | comparative polymer 1(*1) (mean molecular weight, 600) | — | 300 | 0.5 | 5.6 | comparative sample |
| g (1.5 times) | comparative polymer 1(*1) (mean molecular weight, 600) | — | 450 | 0.4 | 4.0 | comparative sample |
| g (2.0 times) | comparative polymer 1(*1) (mean molecular weight, 600) | — | 600 | 0.3 | 1.7 | comparative sample |
| h | comparative polymer 1(*1) (mean molecular weight, 600) | — | 300 | 0.9 | 6.0 | comparative sample |
| h (1.5 times) | comparative polymer 1(*1) (mean molecular weight, 600) | — | 450 | 0.7 | 5.2 | comparative sample |
| h (2.0 times) | comparative polymer 1(*1) (mean molecular weight, 600) | — | 600 | 0.6 | 1.9 | comparative sample |
| i | comparative polymer 1(*1) (mean molecular weight, 3000) | — | 300 | 1.2 | 10.3 | comparative sample |
| i (1.5 times) | comparative polymer 1(*1) (mean molecular weight, 3000) | — | 450 | 1.0 | 9.0 | comparative sample |
| i (2.0 times) | comparative polymer 1(*1) (mean molecular weight, 3000) | — | 600 | 0.9 | 7.0 | comparative sample |
| j | comparative polymer 2(*2) (mean molecular weight, 600) | — | 300 | 0.6 | 6.0 | comparative sample |
| j (1.5 times) | comparative polymer 2(*2) (mean molecular weight, 600) | — | 450 | 0.5 | 4.2 | comparative sample |
| j (2.0 times) | comparative polymer 2(*2) (mean molecular weight, 600) | — | 600 | 0.4 | 1.8 | comparative sample |
| k | comparative polymer 3(*3) (mean molecular weight, 600) | — | 300 | 0.5 | 6.2 | comparative sample |
| k (1.5 times) | comparative polymer 3(*3) (mean molecular weight, 600) | — | 450 | 0.4 | 4.2 | comparative sample |
| k (2.0 times) | comparative polymer 3(*3) (mean molecular weight, 600) | — | 600 | 0.3 | 1.8 | comparative sample |

(*1), (*2), (*3): Comparative polymers 1, 2 and 3 were the same as those in Example 1. Numerals in brackets of "Emulsion (amount)" show an amount of ethylacetate.

From Table 2 above, it is understood that the emulsions of the present invention containing the polymer having the same structure and having a smaller number average molecular weight had a smaller number of coarse grains and that the emulsions of the present invention containing a larger amount of the auxiliary solvent had a smaller number of coarse grains. However, the number of coarse grains in the emulsions each containing the polymer not falling within the scope of the present invention increased after the emulsions had stored in a refrigerator, even though the polymer had a small number average molecular weight. Using these comparative emulsions, multi-layered color photographic materials were prepared as comparative samples in the same manner as in Example 1. In preparing these comparative samples, it was found that when the amount of the auxiliary solvent, ethyl acetate, was increased, then the coated layer became more uneven. Precisely, when 600 ml of ethyl acetate (corresponding to 2.0 times as large as the same solvent used in Example 1) were used in preparing these comparative samples, the coated layer was significantly uneven so that the samples were not on the level for practical use. In these comparative samples, the increase in the amount of the auxiliary solvent is inevitable so as to inhibit the formation of coarse grains in the emulsions. However, the comparative emulsions containing such an increased amount of the auxiliary solvent cannot have good coatability. From the fact, it is obvious that the polymers of the present invention are far superior to the comparative polymers. The photographic materials prepared in this example were subjected to the same light fastness test as in Example 1, and these gave the same results as in Example 1.

EXAMPLE 3

Samples Nos. 201 to 213 were prepared in the same manner as in preparation of Sample No. 104 in Example 1, except that the composition of the second layer was changed to that shown in Table 3 below. In these Samples 201 to 213, the composition of the fourth layer was the same as that of the second layer but the amount of the fourth layer coated was 70% of that of the second layer. These samples were processed under the same conditions as those in Example 1. To assess the light fastness of the thus-processed samples, the samples were directly exposed to sun light for 21 days, without using filters, and the increase in the yellow stains in the exposed (faded) samples was measured using a densitometer, X-Rite 310 (produced by The X-Rite Company). The difference in the yellow density in the white background area between the non-faded (fresh) sample and the faded (exposed) sample is shown in Table 3 below.

TABLE 3

| | Polymer, High Boiling Point Organic Solvent and Ultraviolet Absorbent in Second Layer | | | | | | | |
|---|---|---|---|---|---|---|---|---|
| | Polymer | | High Boiling Point Organic Solvent | | Ultraviolet Absorbent | | Increase in Yellow Stains After | |
| Sample No. | Kind | Amount ($g/cm^2$) | Kind | Amount ($g/cm^2$) | Kind | Amount ($g/cm^2$) | Exposure to Sun Light | Remarks |
| 201 | P-12 (mean molecular weight, 600) | 0.08 | S-32 | 0.40 | — | — | 0.02 | sample of the invention |
| 202 | P-17 (mean molecular weight, 1000) | 0.08 | S-32 | 0.40 | — | — | 0.02 | sample of the invention |
| 203 | P-21 (mean molecular weight, 500) | 0.08 | S-32 | 0.40 | — | — | 0.02 | sample of the invention |
| 204 | comparative polymer 2(*1) (mean molecular weight, 600) | 0.08 | S-32 | 0.40 | — | — | 0.06 | comparative sample |
| 205 | comparative polymer 3(*2) (mean molecular weight, 600) | 0.08 | S-32 | 0.40 | — | — | 0.05 | comparative sample |
| 206 | — | | S-32 | 0.40 | — | — | 0.06 | comparative sample |
| 207 | P-12 (mean molecular weight, 600) | 0.08 | — | — | — | — | 0.02 | sample of the invention |
| 208 | P-12 (mean molecular weight, 600) | 0.08 | S-13 | 0.40 | — | — | 0.02 | sample of the invention |
| 209 | P-12 (mean molecular weight, 600) | 0.08 | S-13 | 0.30 | UV-4(*3) | 0.10 | 0.01 | sample of the invention |
| 210 | P-12 (mean molecular weight, 600) | 0.08 | S-32 | 0.30 | UV-4(*3) | 0.10 | 0.01 | sample of the invention |
| 211 | P-12 (mean molecular weight, 800) | 0.08 | S-30/S-32 (1/1)(*5) | 0.30 | UV-4(*3) | 0.10 | 0.01 | sample of the invention |
| 212 | P-1 (mean molecular weight, 1900) | 0.10 | S-1 | 0.25 | UV-5(*4) | 0.15 | 0.01 | sample of the invention |
| 213 | P-1 (mean molecular weight, 1900) | 0.10 | S-10 | 0.25 | UV-5(*4) | 0.15 | 0.01 | sample of the invention |

(*1), (*2): Same comparative polymers 2 and 3 as those used in Example 1.
(*3): UV-4 is a 4/5/2 (by weight) mixture of I-4/I-7/I-10.
(*4): UV-5 is a 2/3/1/1 (by weight) mixture of I-4/I-7/I-12/I-16.
(*5): The weight ratio of S-30/S-32 is 1/1.

From Table 3 above, it is understood that when the samples of the present invention each containing the particular polymer specifically defined by the present invention were exposed to sun light, the yellow staining of the white background area in them was significantly inhibited. In addition, it is also understood therefrom that the stain-inhibiting effect was augmented in the samples containing the ultraviolet absorbent along with the polymer of the invention.

Other samples were prepared in the same manner as in preparation of Samples Nos. 201 to 213, except that the polymer of the invention and the ultraviolet absorbent were removed form the sixth layer. These samples were tested in the same manner as above. From the test results, it was known that the effect of the present invention was augmented in these samples not containing the polymer and the ultraviolet absorbent in the sixth layer.

EXAMPLE 4

Scanning Exposure

The samples prepared in Example 1 and Example 3 were exposed in the manner mentioned below and then processed in the same manner as in Example 1. The thus-processed samples were evaluated in the same manner as in Example 1, by which the same results as in Example 1 and Example 3 were obtained.

Exposure of Samples

The samples were exposed by scanning exposure. As the light source, used were a monochromatic light of 473 nm that had been prepared by converting the wavelength of a YAG solid laser (oscillating wavelength: 946 nm) combined with an exciting light source of a semiconductor laser GaAlAs (oscillating wavelength: 808.5 nm), using SHG crystals of $KNbO_3$; a monochromatic light of 532 nm that had been prepared by converting the wavelength of a $YVO_4$ solid laser (oscillating wavelength: 1064 nm) combined with an exciting light source of a semiconductor laser GaAlAs (oscillating wavelength: 808.7 nm), using SHG crystals of KTP; and a semiconductor laser AlGaInP (TOLD 9211 Model, made by Toshiba Co.; oscillating wavelength: about 670 nm). The scanning exposure device used here was such that the laser rays were successively applied to the color printing paper, which were being moved in the direction vertical to the scanning direction, by the motion of a rotary polyhedron. Using the device, the samples were exposed while the quantity of light was varied, and the relation (D—logE) between the density (D) of the processed sample and the quantity of light applied (E) was obtained. The three laser rays each having a different wavelength as mentioned above were modulated so as to vary the quantity of light from each ray, using an external modulator, by which the amount of exposure of each sample was controlled. The scanning exposure was effected at 400 dpi, and the mean exposure time was about $5\times10^{-8}$ seconds per one pixel. Using a Peltier device, the temperatures of the semiconductor lasers were kept constant in order to prevent the temperature-dependent fluctuation of the quantity of light from each laser.

According to the present invention which has been explained in detail hereinabove, there is provided a color photographic material capable of forming a color image with high light fastness. The emulsion containing a water-insoluble polymer having aromatic groups and having a mean molecular weight of less than 2000 can be coated uniformly on the photographic support. Thus, using the polymer specifically defined by the present invention, the coatability of the emulsion containing the polymer has been improved to give an evenly coated photographic material and the light fastness of the color image formed on the photographic material has been improved.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having, on a support, a yellow-coloring silver halide emulsion layer, a magenta-coloring silver halide emulsion layer, a cyan-coloring silver halide emulsion layer and at least one non-coloring layer, wherein said non-coloring layer contains at least one water-insoluble polymer having a number average molecular weight of less than 2000 which is obtained by polymerizing at least one monomer having an aromatic group.

2. The silver halide color photographic material as claimed in claim 1, wherein said non-coloring layer contains at least one high boiling point organic solvent having a refractive index of 1.50 or less.

3. The silver halide color photographic material as claimed in claim 1, wherein said water-insoluble polymer is a polymer having, as the constitutive monomer, at least one of styrene, α-methylstyrene and β-methylstyrene.

4. The silver halide color photographic material as claimed in claim 1, wherein the water-insoluble polymer has a number average molecular weight of from 200 to less than 2000.

5. The silver halide color photographic material as claimed in claim 1, wherein the water-insoluble polymer is used in an amount of from 0.01 to 3.00 g per $m^2$ of the material.

6. The silver halide color photographic material as claimed in claim 1, wherein the support is a reflective support.

7. The silver halide color photographic material as claimed in claim 1, wherein the silver halide used in the silver halide emulsion layer is silver chloride, or silver chlorobromide or silver chloroiodobromide containing 95% or more of silver chloride.

8. The silver halide color photographic material as claimed in claim 1, wherein said non-coloring layer contains compound(s) of a general formula (I), (II) or (III):

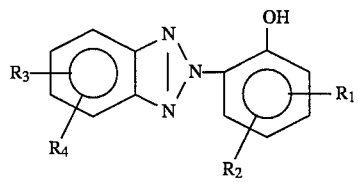

(I)

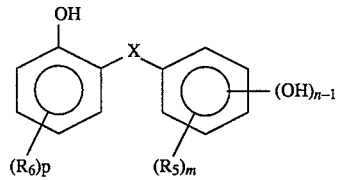

(II)

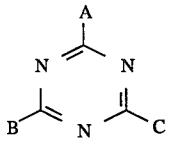

(III)

wherein $R_1$ to $R_4$ each represent a hydrogen atom, a halogen atom, a nitro group, a hydroxyl group, an alkyl group, an alkoxy group, an aryl group, an aryloxy group, an acylamino group, a carbamoyl group, a sulfo group, an alkylthio group or an arylthio group; and $R_1$ and $R_2$, and $R_3$ and $R_4$ each may be bonded to each other to form a ring; $R_5$ and $R_6$ each represent a hydrogen atom, an alkyl group or an acyl group; X represents —CO— or —COO—; and n represents an integer of 1 to 4; m represents an integer of 1 to 5; p represents an integer of 1 to 4; A, B and C each independently represent an alkyl, aryl, alkoxy, aryloxy or heterocyclic group, provided that at least one of A, B and C is a group of a general formula (IV):

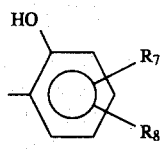

(IV)

wherein $R_7$ and $R_8$ each independently represent a hydrogen atom a halogen atom, or an alkyl, aryl, alkoxy or aryloxy group.

9. The silver halide color photographic material as claimed in claim 8, wherein the alkyl, aryl, alkoxy, aryloxy or heterocyclic group representing A, B or C is substituted by a substituent selected from the group consisting of a hydroxyl group, a halogen atom, an alkyl group having from 1 to 12 carbon atoms, an alkoxy group having from 1 to 18 carbon atoms, an aryloxy group having from 6 to 18 carbon atoms, an alkoxycarbonyl group, an aryloxycarbonyl group, an alkylthio group having from 1 to 18 carbon atoms, and a carbamoyl group.

10. The silver halide color photographic material as claimed in claim 8, wherein the alkyl group which can represent $R_7$ or $R_8$ is a trifluoromethyl or glycidyl group, the aryl group which can represent $R_7$ or $R_8$ is a tolyl group, the alkoxy group which can represent $R_7$ or $R_8$ is a 2-butoxyethoxy or 3-butoxy-2-hydroxypropyloxy group, and the aryloxy group which can represent $R_7$ or $R_8$ is a p-methylphenoxy group.

11. The silver halide color photographic material as claimed in claim 8, wherein at least one of the compounds of formulae (I), (II) and (III) is liquid at room temperature.

12. The silver halide color photographic material as claimed in claim 8, wherein the proportion of the polymer to the compounds of formulae (I), (II), and (III) is from 1 to 200% by weight.

* * * * *